US010003135B1

(12) United States Patent
Strong et al.

(10) Patent No.: US 10,003,135 B1
(45) Date of Patent: Jun. 19, 2018

(54) MECHANICAL USE-LIMITING CONNECTOR FOR ELECTRICAL TOOL

(71) Applicant: ATL Technology, LLC, Springville, UT (US)

(72) Inventors: Matthew Bailey Strong, Provo, UT (US); Guan Hua Yang, Provo, UT (US); John Carl Holloway, Lehi, UT (US)

(73) Assignee: ATL TECHNOLOGY, LLC, Springville, UT (US)

( * ) Notice: Subject to any disclaimer, the term of this patent is extended or adjusted under 35 U.S.C. 154(b) by 0 days. days.

(21) Appl. No.: 15/680,022

(22) Filed: Aug. 17, 2017

Related U.S. Application Data

(60) Provisional application No. 62/475,309, filed on Mar. 23, 2017.

(51) Int. Cl.
*H01R 13/44* (2006.01)
*H01R 3/00* (2006.01)
*H01R 33/00* (2006.01)

(52) U.S. Cl.
CPC ..... *H01R 3/00* (2013.01); *H01R 33/00* (2013.01); *H01R 2201/12* (2013.01)

(58) Field of Classification Search
CPC ..... H01R 3/00; H01R 13/506; H01R 13/502; H01R 33/00; H01H 3/166; B22D 17/145; B24B 55/00
See application file for complete search history.

(56) References Cited

U.S. PATENT DOCUMENTS

| | | | | |
|---|---|---|---|---|
| 4,371,906 | A * | 2/1983 | Alessio | B24B 55/00 200/80 R |
| 4,852,634 | A * | 8/1989 | Kawai | B22D 17/145 164/113 |
| 6,204,463 | B1 * | 3/2001 | Stringos | H01H 3/166 200/296 |
| 6,846,996 | B2 | 1/2005 | Kent et al. | |
| 7,256,362 | B2 | 8/2007 | Kent et al. | |
| 7,273,992 | B2 | 9/2007 | Kent et al. | |
| 7,435,112 | B1 * | 10/2008 | Miller | H01R 13/502 439/133 |
| 9,147,950 | B2 * | 9/2015 | Ballard | H01R 13/506 |

* cited by examiner

*Primary Examiner* — Jean F Duverne
(74) *Attorney, Agent, or Firm* — Kunzer, PC

(57) ABSTRACT

Disclosed herein is a use-limiting connector for limiting use of an electrical tool. The use-limiting connector includes an electrical circuit, a plunger, movable between a first position and a second position, and a biasing member, configured to urge the plunger into the first position and configured to incrementally uncoil into respective torsional states as the plunger moves between the first position and the second position. With the plunger in the first position and the biasing member in a first one of the torsional states, the biasing member closes the electrical circuit. As the plunger moves from the first position to the second position, the plunger moves the biasing member to open the electrical circuit.

20 Claims, 18 Drawing Sheets

MECHANICAL USE-LIMITING CONNECTOR FOR ELECTRICAL TOOL

CROSS-REFERENCE TO RELATED APPLICATION

This application claims the benefit of U.S. Provisional Patent Application No. 62/475,309, filed Mar. 23, 2017, which is incorporated herein by reference.

FIELD

This disclosure relates generally to electrical connectors, and more particularly to an electrical connector that limits the use of an electrical tool.

BACKGROUND

For some medical procedures, limiting the use of an electrically-powered medical tool may be desirable. To limit the use of an electrically-powered medical tool, an electrical connector, configured to supply electrical power to the medical tool for only a pre-determined number of uses, can be coupled to the medical tool. After the pre-determined number of uses is reached, the electrical connector prevents the supply of electrical power to the medical tool.

For some electrical connectors configured to limit the use of an electrically-powered medical tool, the use-limiting features of the connectors can be relatively easily circumvented by manipulating or modifying the features. By circumventing the use-limiting features, the electrical connector may be modified to supply electrical power to the medical tool beyond the pre-determined number of uses. Exceeding the pre-determined number of uses can introduce various undesirable consequences, such as unsanitary medical tools, product liability risks, and manufacturer profitability losses.

SUMMARY

The subject matter of the present application has been developed in response to the present state of the art, and in particular, in response to the problems and needs of conventional devices and methods for limiting the use of an electrical tool that have not yet been fully solved. In view of the foregoing, the subject matter of the present application has been developed to provide a use-limiting connector, and associated system and a method, for limiting the use of an electrical tool that overcome many of the shortcomings of the prior art. For example, the use-limiting connector of the present disclosure helps prevent circumvention of the use-limiting features of the connector compared better than conventional connectors.

Disclosed herein is a use-limiting connector for limiting use of an electrical tool. The use-limiting connector comprises an electrical circuit, a plunger, movable between a first position and a second position, and a biasing member, configured to urge the plunger into the first position and configured to incrementally uncoil into respective torsional states as the plunger moves between the first position and the second position. With the plunger in the first position and the biasing member in a first one of the torsional states, the biasing member closes the electrical circuit. As the plunger moves from the first position to the second position, the plunger moves the biasing member to open the electrical circuit. The preceding subject matter of this paragraph characterizes example 1 of the present disclosure.

After the plunger moves a predetermined number of times from the first position to the second position, the biasing member permanently closes the electrical circuit. The preceding subject matter of this paragraph characterizes example 2 of the present disclosure, wherein example 2 also includes the subject matter according to example 1, above.

The predetermined number of times is one. The preceding subject matter of this paragraph characterizes example 3 of the present disclosure, wherein example 3 also includes the subject matter according to example 2, above.

The predetermined number of times is more than one. The preceding subject matter of this paragraph characterizes example 4 of the present disclosure, wherein example 4 also includes the subject matter according to example 2, above.

The use-limiting connector further comprises a first electrical terminal, a second electrical terminal, and a first non-electrical stop between the first electrical terminal and the second electrical terminal. The first non-electrical stop is electrically isolated from the first electrical terminal and the second electrical terminal. The biasing member slides along the first non-electrical stop as the plunger moves between the first position and the second position. The preceding subject matter of this paragraph characterizes example 5 of the present disclosure, wherein example 5 also includes the subject matter according to any one of examples 1-4, above.

The use-limiting connector further comprises a first electrical stop between the first non-electrical stop and the second electrical terminal. The first electrical stop is electrically coupled to the second electrical terminal. The biasing member alternately slides along the first non-electrical stop and the first electrical stop as the plunger moves between the first position and the second position. The preceding subject matter of this paragraph characterizes example 6 of the present disclosure, wherein example 6 also includes the subject matter according to example 5, above.

The use-limiting connector further comprises a second non-electrical stop between the first electrical stop and the second electrical terminal. The second non-electrical stop is electrically isolated from the first electrical terminal and the second electrical terminal. The biasing member alternately slides along the first electrical stop and the second non-electrical stop as the plunger moves between the first position and the second position. The preceding subject matter of this paragraph characterizes example 7 of the present disclosure, wherein example 7 also includes the subject matter according to example 6, above.

A path is defined between the first non-electrical stop and the first electrical stop and between the second non-electrical stop and the first electrical stop. The path bends around the first electrical stop. The preceding subject matter of this paragraph characterizes example 8 of the present disclosure, wherein example 8 also includes the subject matter according to example 7, above.

The biasing member is made of an electrically conductive material and comprises a first electrical contact and a second electrical contact. The first electrical contact is biased against the first electrical terminal. The second electrical contact is biased away from the first electrical terminal toward the second electrical terminal. When the plunger is in the second position, the second electrical contact of the biasing member is biased against the first non-electrical stop to electrically decouple the first electrical terminal and the second electrical terminal via the biasing member. Movement of the plunger from the second position to the first position urges the second electrical contact away from the first non-electrical stop and into contact with the first electrical stop to electrically couple together the first electrical terminal and the second electrical terminal. The preceding subject matter of this paragraph characterizes example 9 of the present disclosure, wherein example 9 also includes the subject matter according to any one of examples 6-8, above.

The use-limiting connector further comprises a housing, at least partially enclosing the plunger and the biasing member. The housing is made from an electrically non-conductive material and partially electrically insulates the first electrical stop. The use-limiting connector further comprises an electrical bridge, made from an electrically conductive material and permanently electrically coupling together the first electrical stop and the second electrical terminal. The preceding subject matter of this paragraph characterizes example 10 of the present disclosure, wherein example 10 also includes the subject matter according to any one of examples 6-9, above.

The biasing member is made of an electrically conductive material and comprises a first electrical contact and a second electrical contact. The first electrical contact is biased against the first electrical terminal. The second electrical contact is biased away from the first electrical terminal toward the second electrical terminal. When the plunger is in the second position, the second electrical contact of the biasing member is biased against the first non-electrical stop to electrically decouple the first electrical terminal and the second electrical terminal via the biasing member. Movement of the plunger from the second position to the first position urges the second electrical contact away from the first non-electrical stop and into permanent contact with the second electrical terminal to permanently electrically couple together the first electrical terminal and the second electrical terminal via the biasing member. The preceding subject matter of this paragraph characterizes example 11 of the present disclosure, wherein example 11 also includes the subject matter according to any one of examples 5-10, above.

The use-limiting connector further comprises a second electrical stop immediately between the first non-electrical stop and the first terminal. The second electrical stop is electrically coupled to the second electrical terminal. The biasing member alternately slides along the second electrical stop and the first non-electrical stop as the plunger moves between the first position and the second position. The preceding subject matter of this paragraph characterizes example 12 of the present disclosure, wherein example 12 also includes the subject matter according to any one of examples 5-11, above.

The use-limiting connector further comprises a second non-electrical stop immediately between the first non-electrical stop and the first terminal. The second non-electrical stop is electrically isolated from the first electrical terminal and the second electrical terminal. The biasing member alternately slides along the first non-electrical stop and the second non-electrical stop as the plunger moves between the first position and the second position. The preceding subject matter of this paragraph characterizes example 13 of the present disclosure, wherein example 13 also includes the subject matter according to any one of examples 5-11, above.

The biasing member is made of an electrically conductive material and comprises a first electrical contact and a second electrical contact. The first electrical contact is biased against the first electrical terminal. The second electrical contact is biased away from the first electrical terminal toward the second electrical terminal. With the plunger in the first position and the biasing member in a second one of the torsional states, the second electrical contact of the biasing member is biased against the second non-electrical stop to electrically decouple the first electrical terminal and the second electrical terminal. Movement of the plunger from the first position to the second position urges the second electrical contact away from the second non-electrical stop and into contact with the first non-electrical stop to retain electrical decoupling of the first electrical terminal and the second electrical terminal. The preceding subject matter of this paragraph characterizes example 14 of the present disclosure, wherein example 14 also includes the subject matter according to example 13, above.

Also disclosed is a system for limiting use of an electrical tool. The system comprises a use-limiting connector coupled to the electrical tool and a tool controller. The use-limiting connector comprises an electrical circuit, a plunger, movable between a first position and a second position, and a biasing member, configured to urge the plunger into the first position. With the plunger in the first position, the biasing member closes the electrical circuit. As the plunger moves from the first position to the second position, the plunger moves the biasing member to open the electrical circuit. After the plunger moves a predetermined number of times from the first position to the second position, the biasing member permanently closes the electrical circuit. The tool controller comprises a port configured to be mechanically and electrically coupled to the use-limiting connector. The port is further configured to urge the plunger into the second position when the use-limiting connector is mechanically coupled to the port. Control of the electrical tool by the tool controller through the use-limiting connector is enabled when the electrical circuit is open and disabled when the electrical circuit is closed. The preceding subject matter of this paragraph characterizes example 15 of the present disclosure.

Further disclosed is a method of limiting use of an electrical tool. The method comprises mechanically coupling together an electrical tool and a tool controller via a use-limiting connector. The use-limiting connector comprises an electrical circuit. The method also comprises determining whether the electrical circuit of the use-limiting connector is open or closed. The method additionally comprises, when the electrical circuit is closed, disabling control of the electrical tool by the tool controller. The method also comprises, when the electrical circuit is open, enabling control of the electrical tool by the tool controller. The preceding subject matter of this paragraph characterizes example 16 of the present disclosure.

The electrical circuit is permanently closed after the use-limiting connector is used a predetermined number of times to mechanically couple together the electrical tool and the tool controller. The preceding subject matter of this paragraph characterizes example 17 of the present disclosure, wherein example 17 also includes the subject matter according to example 16, above.

The electrical circuit is closed when a biasing member of the use-limiting connector is electrically coupled to a second electrical terminal of the use-limiting connector. The electrical circuit is open when the biasing member of the use-limiting connector is electrically decoupled from the second electrical terminal of the use-limiting connector. Mechanically coupling together the electrical tool and the tool controller moves a plunger of the use-limiting connector from a first position to a second position. The method further comprises electrically coupling the biasing member and the second electrical terminal when (1) the plunger is in the first position and before the use-limiting connector is used the predetermined number of times; and (2) the plunger is in the second position and after the use-limiting connector is used the predetermined number of times. The method further comprises electrically decoupling the biasing member and the second electrical terminal when the plunger is in the second position and before the use-limiting connector is used the predetermined number of times. The preceding subject matter of this paragraph characterizes example 18 of the present disclosure, wherein example 18 also includes the subject matter according to example 17, above.

Also disclosed is a method of limiting use of an electrical tool. The method comprises mechanically coupling together an electrical tool and a tool controller via a use-limiting connector. The use-limiting connector comprises an electrical circuit. The method also comprises determining whether the electrical circuit of the use-limiting connector is open or closed. The method further comprises, when the electrical circuit is closed, enabling control of the electrical tool by the tool controller. The method additionally comprises, when the electrical circuit is open, disabling control of the electrical tool by the tool controller. The preceding subject matter of this paragraph characterizes example 19 of the present disclosure.

The electrical circuit is permanently open after the use-limiting connector is used a predetermined number of times to mechanically couple together the electrical tool and the tool controller. The electrical circuit is open when a biasing member of the use-limiting connector is non-electrically coupled to a non-electrical terminal or a non-electrical stop of the use-limiting connector. The electrical circuit is closed when the biasing member of the use-limiting connector is electrically coupled to an electrical stop of the use-limiting connector. Mechanically coupling together the electrical tool and the tool controller moves a plunger of the use-limiting connector from a first position to a second position. The method further comprises non-electrically coupling the biasing member and the non-electrical terminal or the non-electrical stop when (1) the plunger is in the first position and before the use-limiting connector is used the predetermined number of times; and (2) the plunger is in the second position and after the use-limiting connector is used the predetermined number of times. The method further comprises electrically coupling the biasing member and the electrical stop when the plunger is in the second position and before the use-limiting connector is used the predetermined number of times. The preceding subject matter of this paragraph characterizes example 20 of the present disclosure, wherein example 20 also includes the subject matter according to example 19, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
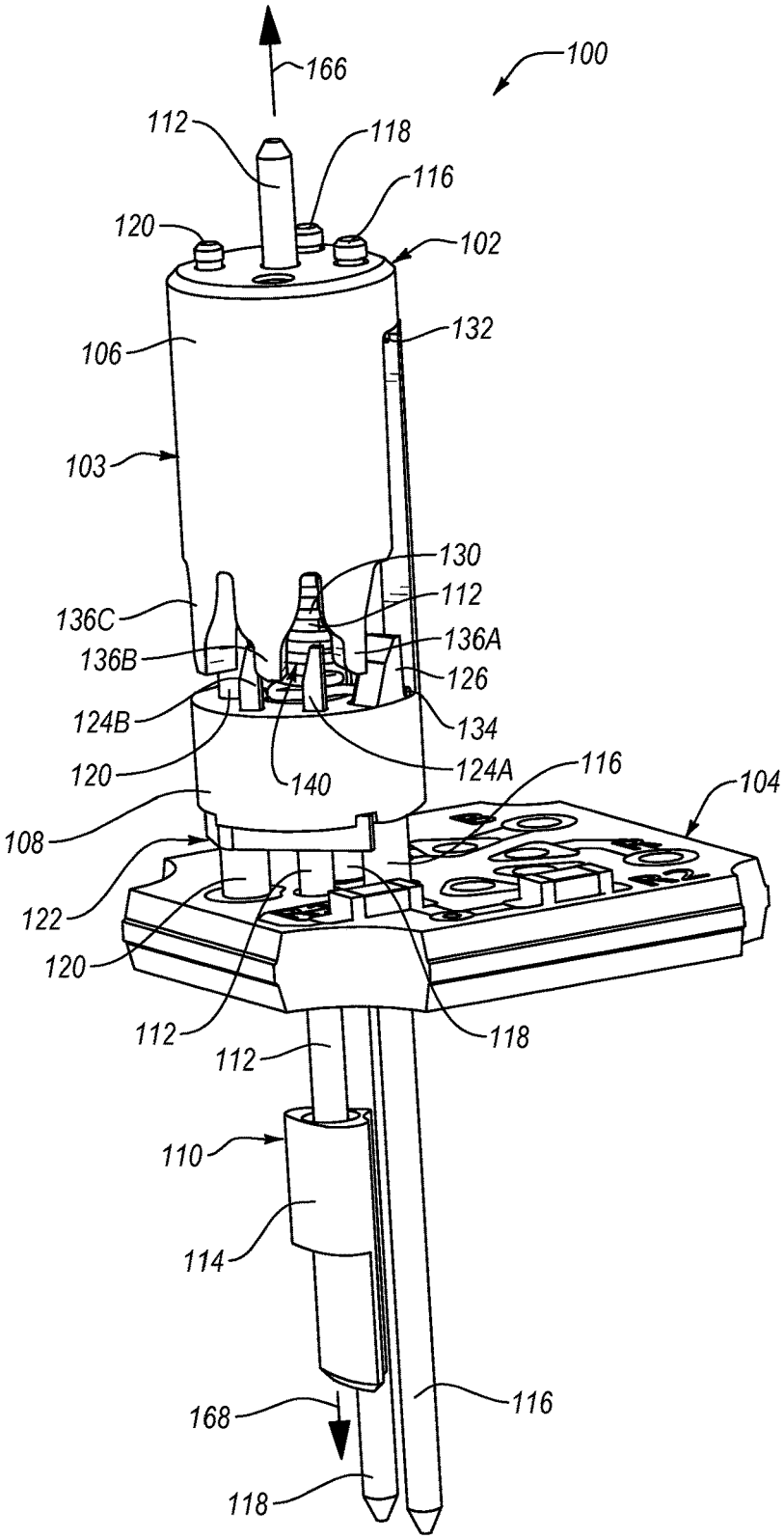
FIG. 1 illustrates a first perspective view of a use-limiting connector, according to one or more examples of the present disclosure.
Figure 2:
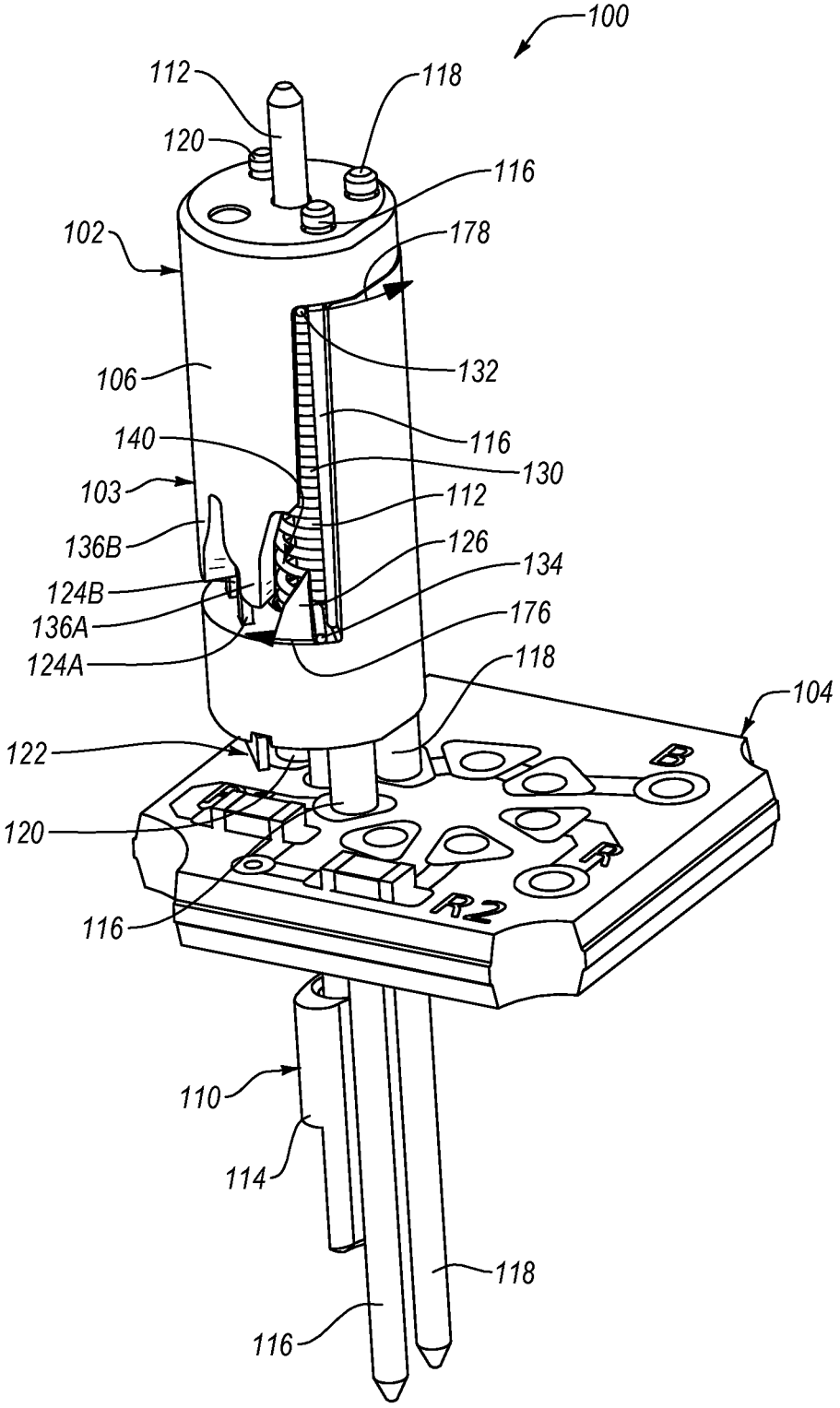
FIG. 2 illustrates a second perspective view of the use-limiting connector of FIG. 1, according to one or more examples of the present disclosure.
Figure 3:
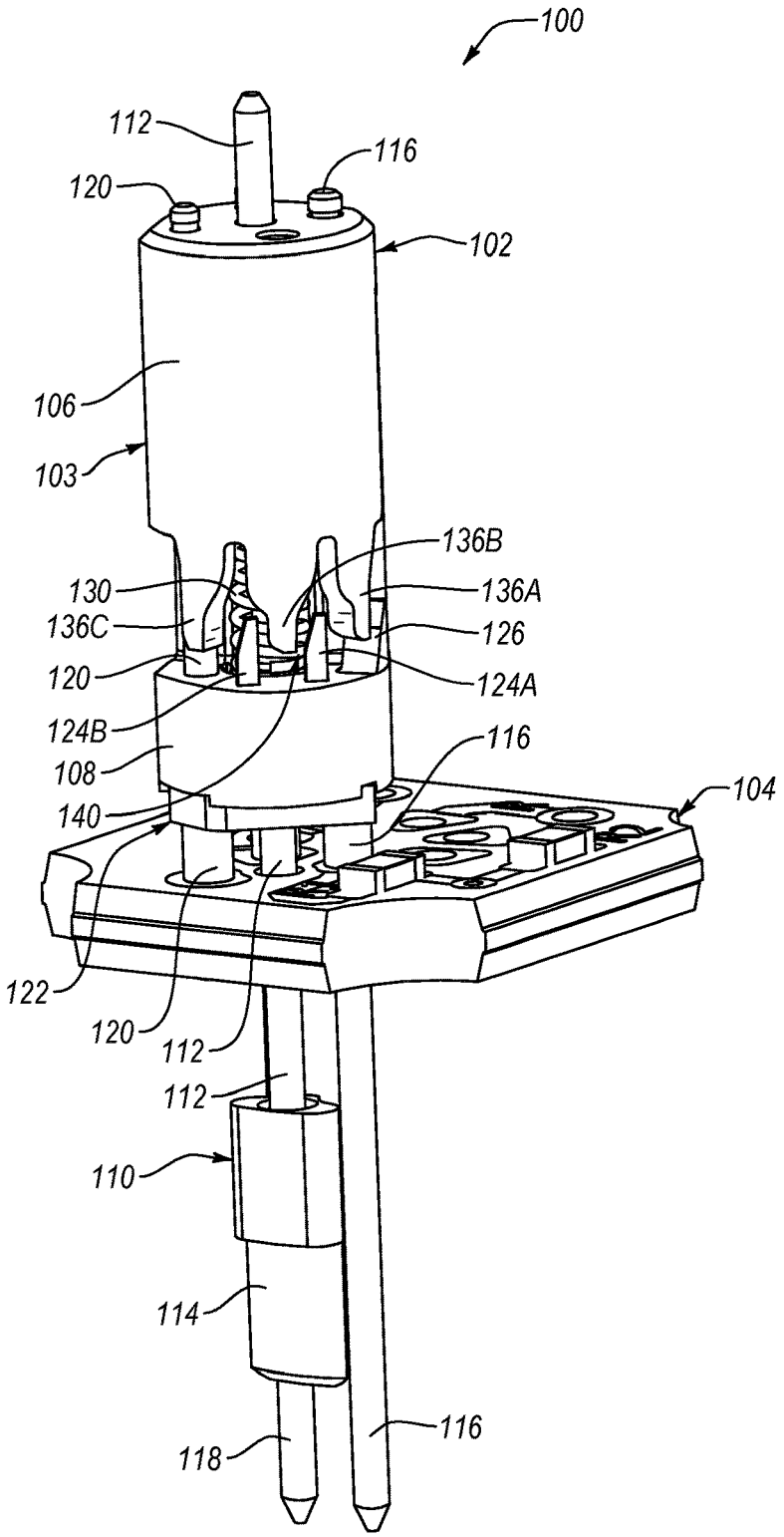
FIG. 3 illustrates a third perspective view of the use-limiting connector of FIG. 1, according to one or more examples of the present disclosure.
Figure 4:
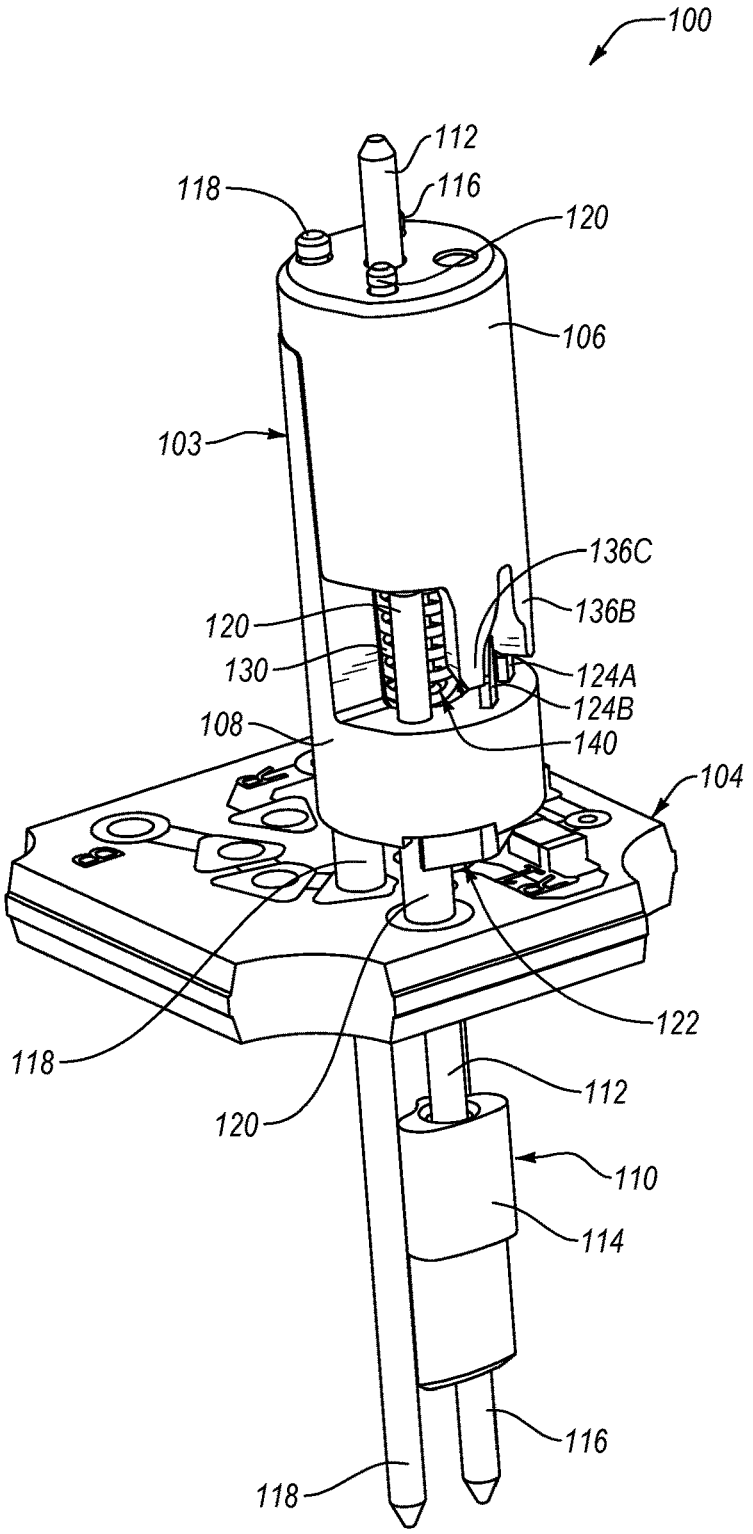
FIG. 4 illustrates a fourth perspective view of the use-limiting connector of FIG. 1, according to one or more examples of the present disclosure.
Figure 5:
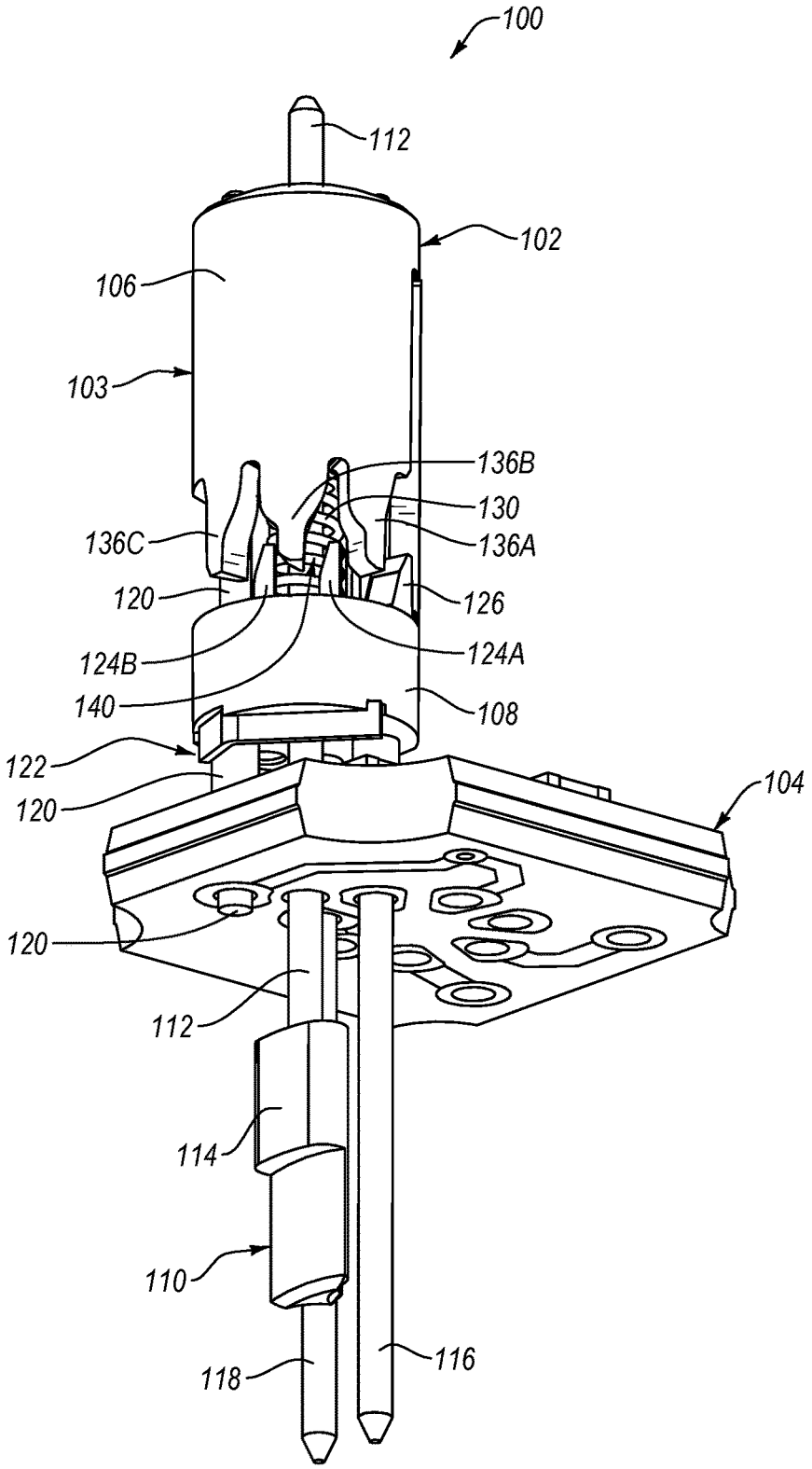
FIG. 5 illustrates a fifth perspective view of the use-limiting connector of FIG. 1, according to one or more examples of the present disclosure.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

FIGS. 1-6 respectively illustrate various perspective views of one embodiment of a use-limiting connector 100 for limiting use of an electrical tool. As shown schematically in FIG. 7 and according to one embodiment, the use-limiting connector 100 is non-removably coupled to an electrical tool 170 and removably coupleable to a tool controller 172 (e.g., capital equipment) to form a system 200. The electrical tool 170 can be any of various electrical tools known in the art, such as medical devices. The tool controller 172 is configured to control operation of the electrical tool 170, including, but not limited to, providing electrical power to the electrical tool 170. Power and/or communication signals for controlling operation of the electrical tool 170 are transmitted to the electrical tool 170 from the tool controller 172 via the use-limiting connector 100. Although not shown, the system 200 may further include one or more cables that electrically and mechanically couple the electrical tool 170 to the use-limiting connector 100 and one or more cables that electrically and mechanically couple the tool controller 172 to the use-limiting connector 100.

According to one example of use of the system 200, the electrical tool 170 is a disposable medical tool used in a sterilized working environment, such as an operating room or other healthcare facility. The disposable medical tool can be designated for limited use (e.g., one use) on a limited number of patients (e.g., one patient) before being discarded. Moreover, in certain implementations, the disposable medical tool may come pre-packaged with the use-limiting connector 100 in a sanitized state. A medical technician then opens the package, removes the sterilized medical tool and use-limiting connector 100, and mates the use-limiting connector 100 to the tool controller 172, which controls operation of the medical tool. After a first use of the medical tool is completed, the use-limiting connector 100 is demated from the tool controller 172. If the first use of the use-limiting connector 100 meets a predetermined use limit of the use-limiting connector 100, then the use-limiting connector 100 facilitates prevention of further use of the medical tool. Because the medical tool is prevented from further use, the medical tool, as well as the use-limiting connector 100, is discarded. However, if the first use of the medical tool does not meet the predetermined use limit of the use-limiting connector 100, then the medical tool can be remated with the tool controller 172 via the use-limiting connector 100 and used an additional time. The pattern of mating, using, and demating the medical tool via the use-limiting connector 100 can be repeated any number of times up to the predetermined use limit of the use-limiting connector 100, at which time the medical tool and the use-limiting connector 100 are discarded. In some implementations, the predetermined use limit is one. In other implementations, the predetermined use limit is more than one, such as two, three, or more.

The use-limiting connector 100 includes a use-limiting mechanism 102 coupled to a base 104. In some embodiments, the base 104 is a printed circuit board with circuitry for facilitating the transmission of electrical signals associated with operation of the use-limiting mechanism 102, the electrical tool 170, and/or the tool controller 172. Accordingly, the printed circuit board may include electrical traces and electrical hardware (e.g., resistors, capacitors, inductors, etc.) coupled to (e.g., printed on, mounted to, deposited on, etc.) an electrically insulating board. The base 104 may also provide a rigid structure to which a cover 154 is attached (see, e.g., FIG. 7). The cover 154 encloses the use-limiting connector 100 to provide protection from external contaminants and tampering.

The use-limiting mechanism 102 includes a housing 103. In the illustrated embodiment, the housing 103 includes a first housing portion 106 and a second housing portion 108. In other words, the first housing portion 106 and the second housing portion 108 collectively form the housing 103. The first housing portion 106 and the second housing portion 108 can be separately formed and attached to each other. Alternatively, the first housing portion 106 and the second housing portion 108 can be co-formed together and have a one-piece monolithic construction. According to one implementation, the housing 103, including the first housing portion 106 and the second housing portion 108 are made of an electrically non-conductive material. Moreover, the housing 103 has a generally cylindrical shape with some portions having a circular outer-peripheral shape.

The use-limiting mechanism 102 further includes a plunger 110. The plunger 110 includes a shaft 112 that passes entirely through the housing 103 of the use-limiting mechanism 102. More specifically, the first housing portion 106 and the second housing portion 108 include apertures through which the shaft 112 of the plunger 110 extends. Additionally, the base 104 includes an aperture through which the shaft 112 extends. The apertures are sized to retain the shaft 112 in axial alignment with a first direction 166 and a second direction 168, opposite the first direction, and to allow the shaft 112 to translationally move along the first direction 166 and the second direction 168 while retained by the apertures. In certain implementations, a first end of the shaft 112 extends out of the first housing portion 106 in the first direction 166 and an opposing second end of the shaft 112 extends out of the base 104 in the second direction 168. The second end of the shaft 112 may include a controller engagement element 114 configured to engage a port or interface of the tool controller 172 when the use-limiting connector 100 is electrically and mechanically coupled with the port.

Figure 6:
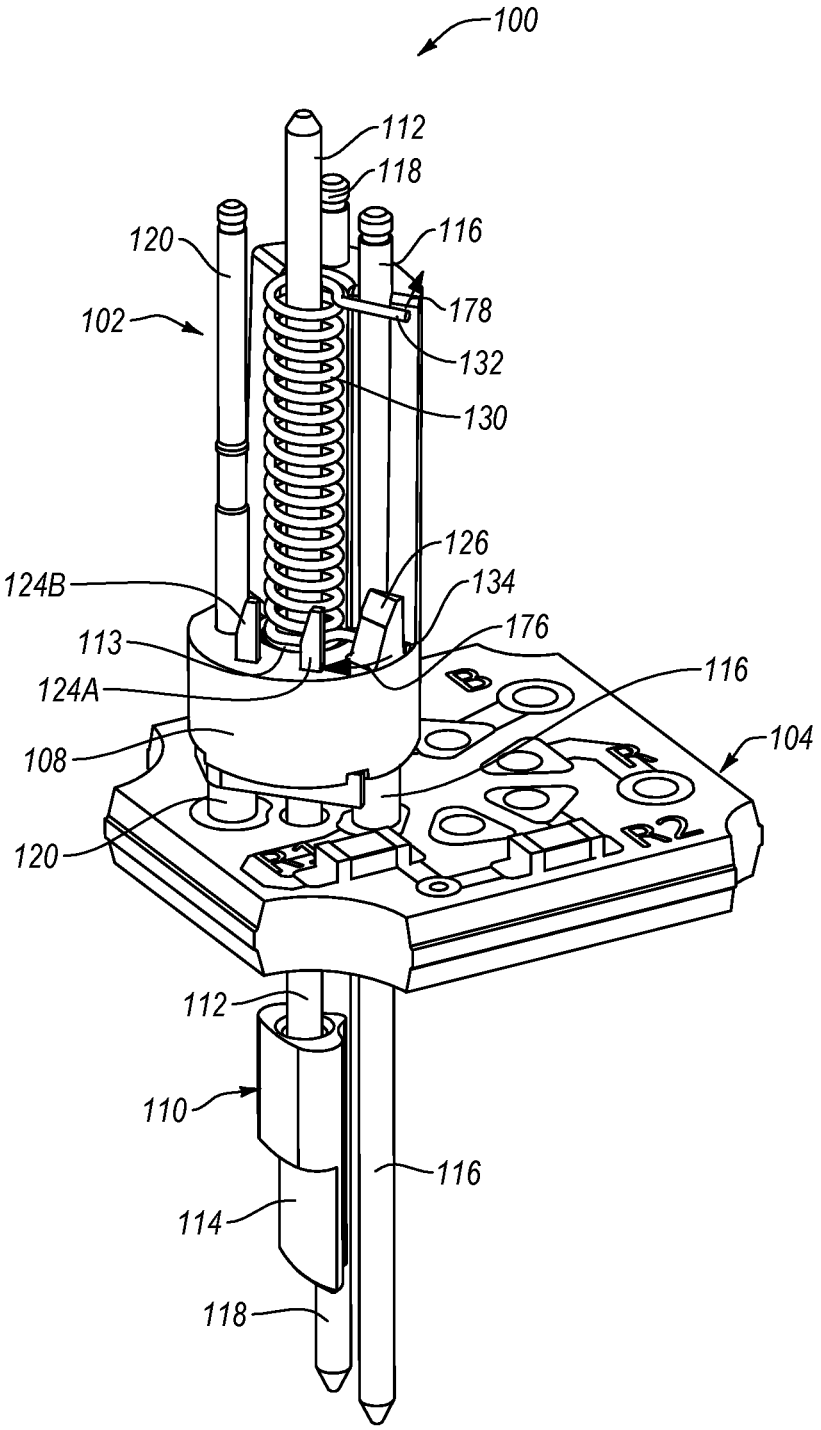
FIG. 6 illustrates a sixth perspective view of the use-limiting connector of FIG. 1, shown with a first housing portion removed, according to one or more examples of the present disclosure.
Figure 7:
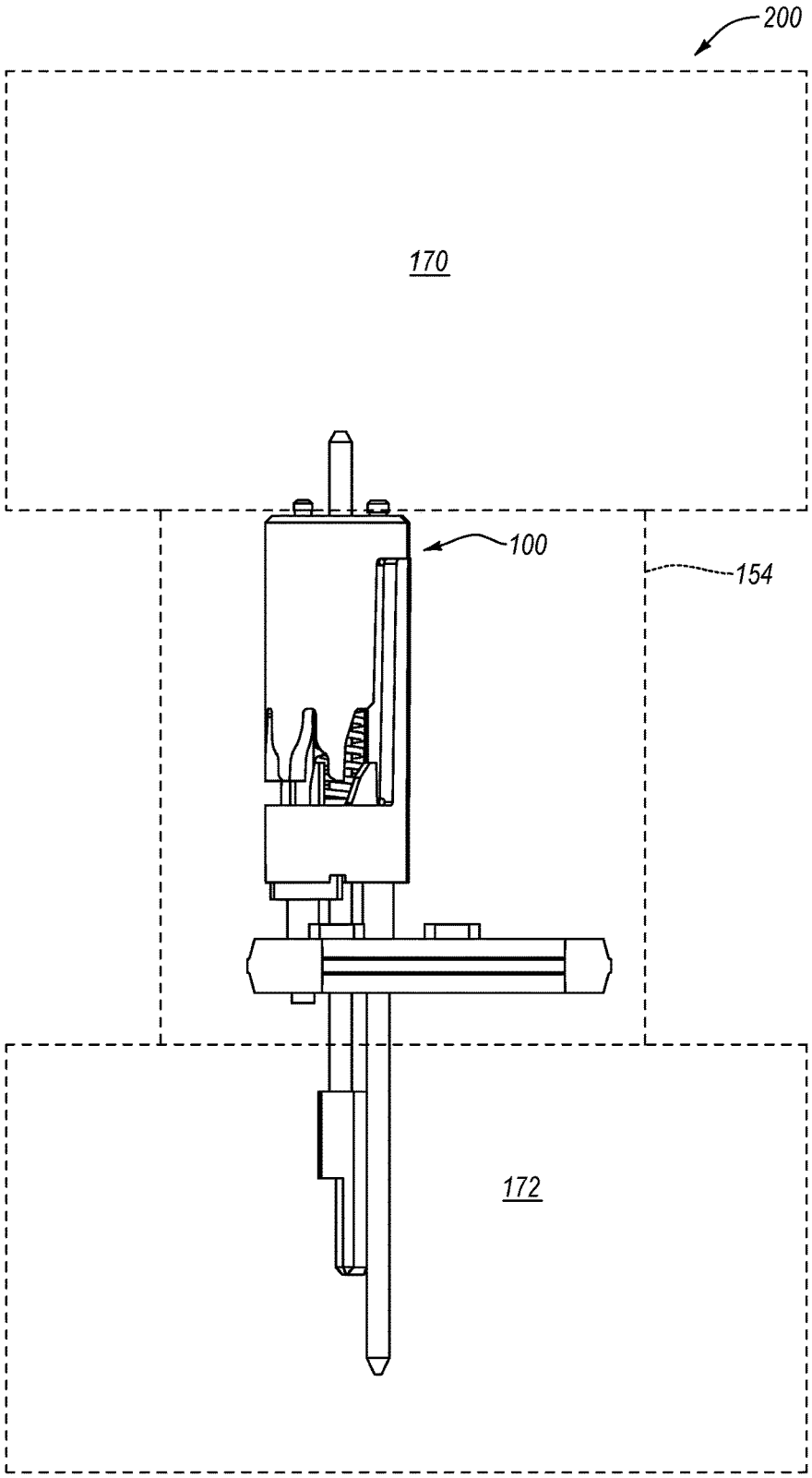
FIG. 7 illustrates a side elevation view of a system for limiting use of an electrical tool, according to one or more examples of the present disclosure.

Referring to FIG. 6, the plunger 110 further includes a seat 113 or shoulder non-movably fixed relative to the shaft 112 so as to be co-movable with the shaft 112. The seat 113 has a circumference that is greater than the circumference of the shaft 112 and at least equal to a circumference of a biasing member 130 of the use-limiting mechanism 102.

The first housing portion 106 includes at least one non-electrical stop at an interface between the first housing portion 106 and the second housing portion 108. Similarly, the second housing portion 108 includes at least one electrical stop at the interface between the first housing portion 106 and the second housing portion 108. The at least one non-electrical stop protrudes from the first housing portion 106 in the second direction 168, while the at least one electrical stop protrudes from the second housing portion in the first direction 166. At the interface, the at least one non-electrical stop is spaced apart circumferentially and axially from the at least one electrical stop such that a gap is defined between the at least one non-electrical stop and the at least on electrical stop. The gap defines a path 140 that extends between and along the at least one non-electrical stop and the at least one electrical stop.

The number of non-electrical stops and electrical stops corresponds with the predetermined use limit. For example, the number of non-electrical stops is equal to the predetermined use limit in some implementations. Additionally, the number of electrical stops is equal to the predetermined use limit minus one in certain implementations and equal to the predetermined use limit in other implementations. In the illustrated implementation, the first housing portion 106 includes three non-electrical stops 136A-C, respectively, corresponding with a predetermined use limit of three, and the second housing portion 108 includes two electrical stops 124A-B, respectively. Of course, the use-limiting mechanism 102 may have only one non-electrical stop corresponding with a predetermined use limit of one. Each of the electrical stops 124A-B is positioned circumferentially between two adjacent non-electrical stops 136A-136C. For example, the electrical stop 124A is positioned within the circumferential gap between the non-electrical stop 136A and the non-electrical stop 136B, and the electrical stop 124B is positioned within the circumferential gap between the non-electrical stop 136B and the non-electrical stop 136C. With the electrical stops 124A-B positioned circumferentially between two adjacent non-electrical stops 136A-136C, the path 140 has a circuitous shape or a wavy shape that effectively bends around the electrical stops and non-electrical stops.

The non-electrical stops 136A-C and electrical stops 124A-B can have any of various protruding shapes sufficient for stopping circumferentially directed motion, in a first circumferential direction 176, of a second electrical contact 134 of the biasing member 130. For example, in the illustrated embodiment, each of the non-electrical stops 136A-C and electrical stops 124A-B has a generally tooth-like or triangular shape. In other implementations, the non-electrical stops 136A-C and electrical stops 124A-B have a square or rectangular shape.

The non-electrical stops 136A-C are made of an electrically non-conductive material, such as plastic. In some implementations, the non-electrical stops 136A-C are co-formed with other features of the first housing portion 106 to form a monolithic one-piece construction with the first housing portion 106. However, in other implementations, the non-electrical stops 136A-C are separately formed and attached to other features of the first housing portion 106.

The electrical stops 124A-B are made of an electrically conductive material, such as a metal (e.g., copper). In some implementations, the electrical stops 124A-B include an electrically non-conductive portion co-formed with other features of the second housing portion 108, to form a monolithic one-piece construction with the second housing portion 108, and coated with an electrically conductive material. However, in other implementations, as shown, the electrical stops 124A-B are separately formed as part of an electrical connector 122 that is secured to and partially electrically insulated by the second housing portion 108. In the illustrated implementation, the electrical connector 122 includes an electrical bridge that mechanically and electrically couples together the electrical stops 124A-B. The electrical bridge can be exposed at an exterior of the second housing portion 108 with the electrical stops 124A-B extending through and protruding from the second housing portion 108. The electrical connector 122 is electrically coupled with a second electrical terminal 120 to electrically couple the electrical stops 124A-B with the second electrical terminal 120. In some implementations, each of the electrical stops 124A-B is separately coupled to the base 104 and electrically coupled with the second electrical terminal 120 via traces on the base 104.

In the illustrated embodiment, the second housing portion 108 further includes a non-electrical stop 126 located circumferentially adjacent the electrical stop 124A in the second circumferential direction 178. The non-electrical stop 126 can be any of various protruding shapes sufficient for stopping circumferentially directed motion, in the first circumferential direction 176, of the second electrical contact 134 of the biasing member 130. For example, in the illustrated embodiment, the non-electrical stop 126 has a generally tooth-like or triangular shape. In other implementations, the non-electrical stop 126 has a square or rectangular shape. The non-electrical stop 136A is positioned circumferentially between the electrical stop 124A and the non-electrical stop 126 such that a portion of the path 140 is defined by the non-electrical stop 126.

In some implementations, the non-electrical stop 126 is replaced by an electrical stop, similar to the electrical stops 124A-B. In fact, according to certain implementations, the non-electrical stop 126 can be an additional (e.g., third) electrical stop of the electrical connector 122 and be electrically and mechanically coupled to the electrical stops 124A-B via the electrical bridge of the electrical connector 122.

The use-limiting mechanism 102 also includes a first electrical terminal 116 and a second electrical terminal 120. The first electrical terminal 116 and the second electrical terminal 120 are made of an electrically conductive material. Generally, the first electrical terminal 116 and the second electrical terminal 120 are at least partially housed within the housing 103 of the use-limiting mechanism. More specifically, the first electrical terminal 116 and the second electrical terminal 120 extend through an interior of the housing 103 in a radially spaced part manner relative to the shaft 112 of the plunger 110. The first electrical terminal 116 and the second electrical terminal 120 are elongate, rod-like elements. In one embodiment, the first electrical terminal 116 and the second electrical terminal 120 extend through an entirety of the housing 103 and extend out of the housing 103 in the second direction 168 to be electrically coupled with the base 104. In some implementations, the first electrical terminal 116 further extends through the base 104 to be positioned for electrical coupling with a tool controller 172 when the use-limiting connector 100 is mated with the tool controller 172.

The use-limiting mechanism 102 further includes a third electrical terminal 118, similar in configuration to the first electrical terminal 116, in some implementations. Like the first electrical terminal 116, the third electrical terminal 118 extends through the housing 103 and electrically couples with the base 104. In some implementations, the third electrical terminal 118 further extends through the base 104 to be positioned for electrical coupling with a tool controller 172 when the use-limiting connector 100 is mated with the tool controller 172.

Although not shown, the use-limiting connector 100 includes additional electrical terminals electrically coupled to the base 104 at one or more of the various apertures shown in the base 104. The electrical terminals may extend through the base 104 so as to be positioned for electrical coupling with the tool controller 172 when the use-limiting connector 100 is mated with the tool controller 172. Additionally, or alternatively, the electrical terminals may be electrically coupled with the electrical tool 170 to establish electrical communication between the tool controller 172 and the electrical tool 170 via the base 104.

The first electrical terminal 116 is electrically coupled with the second electrical terminal 120, via an electrical trace 152 (see, e.g., FIGS. 8A-8H), to form an open electrical circuit or a portion of a closed electrical circuit as will be explained in more detail below. The electrical trace 152 forms part of or is electrically coupled with an enablement module 160 (see, e.g., FIGS. 8A-8H), which can be a module of the tool controller 172, a module of the use-limiting connector 100 (e.g., onboard microprocessor), and/or a module of another structure. In one implementation, the first electrical terminal 116 is electrically coupled with the second electrical terminal 120 at the tool controller 172 when the use-limiting connector 100 is mated with the tool controller 172. For example, when mated, the first electrical terminal 116 is releasably electrically coupled to an electrical trace 152 or bridging electrical terminal of the tool controller 172 and the second electrical terminal 120 is also releasably electrically coupled to the same electrical trace 152 or bridging electrical terminal of the tool controller 172. In such an example, the second electrical terminal 120 is indirectly electrically coupled to the electrical trace 152 via another electrical terminal of the use-limiting connector 100, such as the third electrical terminal 118, and traces on the base 104. In other words, the second electrical terminal 120 may be electrically coupled to another electrical terminal of the use-limiting connector 100 via a trace or traces on the base 104.

According to another implementation, the first electrical terminal 116 is electrically coupled with the second electrical terminal 120 within the use-limiting connector 100 to form the open electrical circuit or the portion of the closed electrical circuit within the use-limiting connector 100, as opposed to at the tool controller 172. In other words, the electrical trace 152 is formed as part of the use-limiting connector 100, such as on the base 104. In such an implementation, the first electrical terminal 116 is electrically coupled with the second electrical terminal 120 via one or more traces of the base 104.

The biasing member 130 in the illustrated embodiment is a spring. More specifically, the biasing member 130 shown is a compression spring that is torsionally pre-loaded. In other words, the biasing member 130 can be a combined compression/torsion spring that resists both compression of the spring and torsion of the spring. The biasing member 130 is positioned within the housing 103 of the use-limiting mechanism 102. Moreover, the biasing member 130 includes a coiled portion through which the shaft 112 of the plunger 110 extends. The shaft 112 is movable within the coiled portion of the biasing member 130 in the first direction 166 and the second direction 168. The biasing member 130 includes two opposing ends protruding from the coiled portion. The biasing member 130 is made of an electrically conductive material, such as copper. Accordingly, the two opposing ends of the biasing member 130 define first and second electrical contacts 132, 134, respectively.

The first electrical contact 132 is translationally and rotationally fixed relative to the housing 103. More specifically, the first electrical contact 132 abuts a cap of the first housing portion 106, which prevents translational movement of the first electrical contact 132 in the first direction 166 relative to the housing 103. Moreover, the compression bias of the biasing member 130 urges the first electrical contact 132 against the cap of the first housing portion 106 such that translational movement of the first electrical contact 132 in the second direction 168 relative to the housing 103 is constrained. The torsional bias of the biasing member 130 urges the first electrical contact 132 in the second circumferential direction 178 against the first electrical terminal 116. The first electrical terminal 116 acts as a stop to prevent rotational movement of the first electrical contact 132 in the second circumferential direction 178 relative to the housing 103. In this manner, electrical connectivity between the biasing member 130 and the first electrical terminal 116 is maintained (e.g., permanently established) during further use of the use-limiting connector 100.

The second electrical contact 134 translationally and rotationally moves relative to the housing 103 during use of the use-limiting connector 100. In one implementation, the second electrical contact 134 abuts a base of the second housing portion 108, which constrains translational movement of the second electrical contact 136 in the second direction 168. Moreover, the compression bias of the biasing member 130 urges the second electrical contact 134 against the base of the second housing portion 108 such that translational movement of the second electrical contact 134 in the second direction 168 relative to the housing 103 is limited. The compression bias of the biasing member 130 also urges the second electrical contact 134 against the seat 113 of the plunger 110 as the plunger 110 moves in the first direction 166. The torsional bias of the biasing member 130 urges the second electrical contact 134 in the first circumferential direction 176 against one of the non-electrical stop 126, the non-electrical stops 136A-C, or the electrical stops 124A-B depending on the use status of the use-limiting connector 100.

The non-electrical stop 126, the non-electrical stops 136A-C, the electrical stops 124A-B, and the second electrical terminal 120 act as stops to prevent rotational movement of the second electrical contact 134 in the first circumferential direction 176 relative to the housing 103. When the second electrical contact 134 is urged against any one of the electrical stops 124A-B or the second electrical terminal 120, an electrical circuit between the first electrical terminal 116 and the second electrical terminal 120 is closed via the biasing member 130. In other words, an electrical current is allowed to flow through the first electrical terminal 116, the second electrical terminal 120, and the biasing member 130 when the second electrical contact 134 is urged against any one of the electrical stops 124A-B or the second electrical terminal 120. However, when the second electrical contact 134 is urged against any one of the non-electrical stop 126 or the non-electrical stops 136A-C, an electrical circuit between the first electrical terminal 116 and the second electrical terminal 120 is open via the disruption of the electrical connection between the first and second electrical terminals 116, 120 and the biasing member 130. In other words, an electrical current is allowed to flow through the first electrical terminal 116, the second electrical terminal 120, and the biasing member 130 when the second electrical contact 134 is urged against any one of the electrical stops 124A-B or the second electrical terminal 120

Generally, operational control of a medical tool connected to the use-limiting connector is non-enabled or disallowed by the use-limiting connector 100, when the electrical circuit between the first electrical terminal 116 and the second electrical terminal 120 is closed, and enabled or allowed, when the electrical circuit between the first electrical terminal 116 and the second electrical terminal 120 is open. It is recognized that in some implementations, this configuration can be reversed as desired (i.e., operation control of the medical tool is non-enabled or disallowed when the electrical circuit between the first electrical terminal 116 and the second electrical terminal 120 is open, and enabled or allowed, when the electrical circuit between the first electrical terminal 116 and the second electrical terminal 120 is closed). Referring to FIGS. 8A-8H, a life cycle of the use-limiting connector 100 of the illustrated embodiments is shown with each one of FIGS. 8A-8H illustrating a different stage of the life cycle. Changing between one stage of the life cycle and a subsequent stage of the life cycle occurs each time the plunger 110 moves between a first position and a second position, as will be explained in more detail below.

The life cycle of the use-limiting connector 100 starts before the use-limiting connector 100 is mated with a tool controller 172 for the first time and ends when the use-limiting connector 100 is demated from the tool controller 172 for the last time, which is equal to the predetermined use limit of the use-limiting connector 100. Throughout the life cycle of the use-limiting connector 100, the first electrical contact 132 of the biasing member 130 remains in contact with the first electrical terminal 116. In contrast, during the life cycle of the use-limiting connector 100, the second electrical contact 134 moves along the path 140 under the compressional and torsional biasing forces of the biasing member 130. For example, from stage to stage of the life cycle of the use-limiting connector 100, the biasing member 130 incrementally uncoils from one torsional state (e.g., a more coiled state) to another torsional state (e.g., a less coiled state).

Figure 8A:
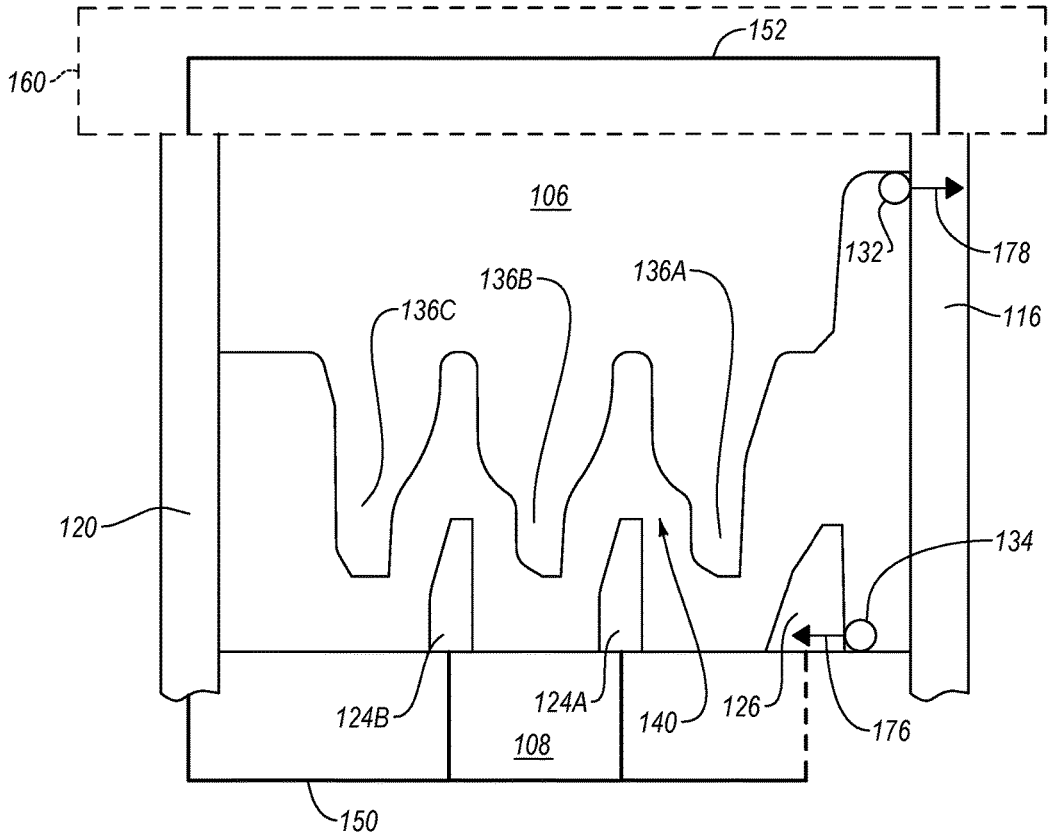
FIG. 8A illustrates a schematic representation of a use-limiting connector, in a first stage of a life cycle of the use-limiting connector, according to one or more examples of the present disclosure.

As shown in FIG. 8A, according to a first or initial stage of the use-limiting connector 100, prior to a first and initial mating between the use-limiting connector 100 and a tool controller 172, the plunger 110 is in a first position or extended position, such as shown in FIGS. 1-6, and the second electrical contact 134 is urged against the non-electrical stop 126. With the second electrical contact 134 in this position, the electrical circuit containing the first electrical terminal 116 and the second electrical terminal 120 is open. The use-limiting connector 100 may be configured in this position when packaged and delivered to an end user.

Figure 8B:
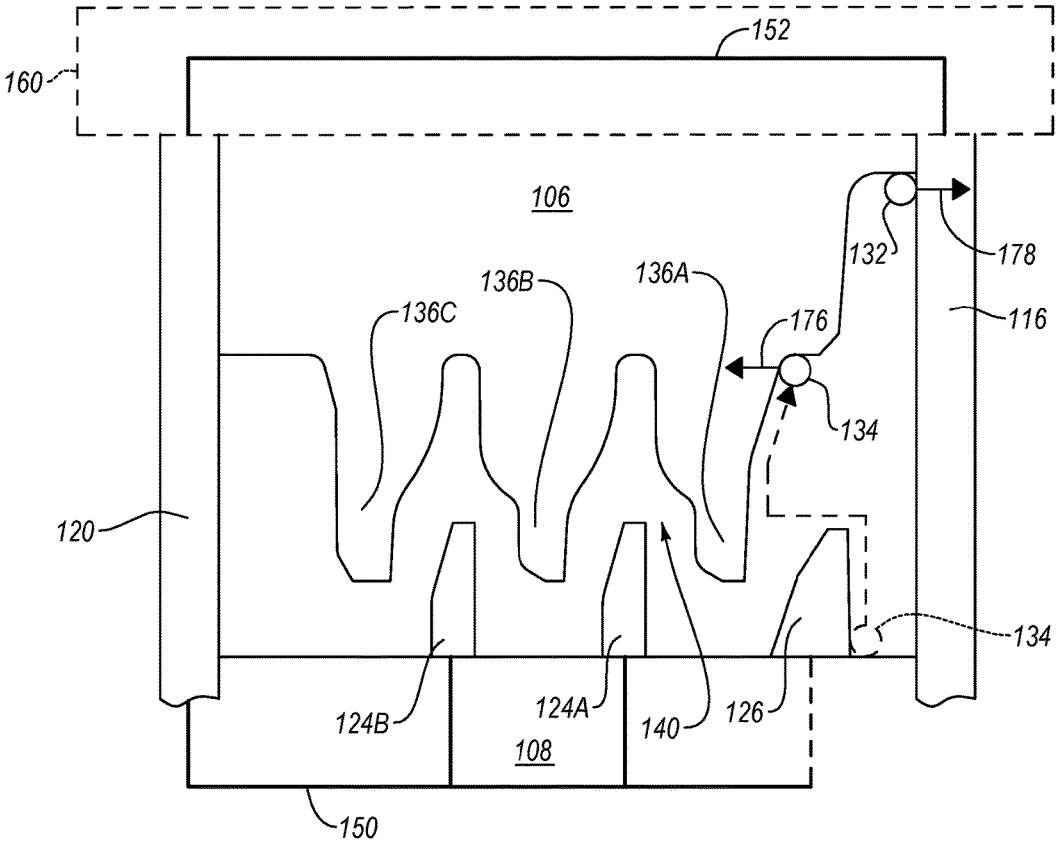
FIG. 8B illustrates a schematic representation of the use-limiting connector of FIG. 8A, in a second stage of the life cycle of the use-limiting connector, according to one or more examples of the present disclosure.

Referring to FIG. 8B, according to a second stage of the use-limiting connector 100, as the use-limiting connector 100 is mated with the tool controller 172, the plunger 110 moves in the first direction 166 from the first position to a second position or retracted position. Movement of the plunger 110 in the first direction 166 results in the seat 113 of the plunger 110 engaging and further compressing the biasing member 130. Compression of the biasing member 130 causes the second electrical contact 134 to move in the first direction 166 along with the plunger 110. As indicated by the path in dashed lines, the torsional bias of the biasing member 130 maintains the second electrical contact 134 against the non-electrical stop 126 as the second electrical contact 134 moves in the first direction 166 until the second electrical contact 134 clears the non-electrical stop 126, at which time the torsional bias of the biasing member 130 causes the second electrical contact 134 to rotate in the first circumferential direction 176 until it engages the non-electrical stop 136A. The second electrical contact 134 travels along the non-electrical stop 136A substantially in the first direction 166 until the plunger 110 reaches the second position (associated with a complete mating of the use-limiting connector 100 with the tool controller 172), at which time the second electrical contact 134 remains engaged with the non-electrical stop 136A by virtue of the torsional bias in the first circumferential direction 176. Because the electrical circuit is open, after the first or initial mating of the use-limiting connector 100 with the tool controller 172, control of the tool by the tool controller 172 is enabled.

Figure 8C:
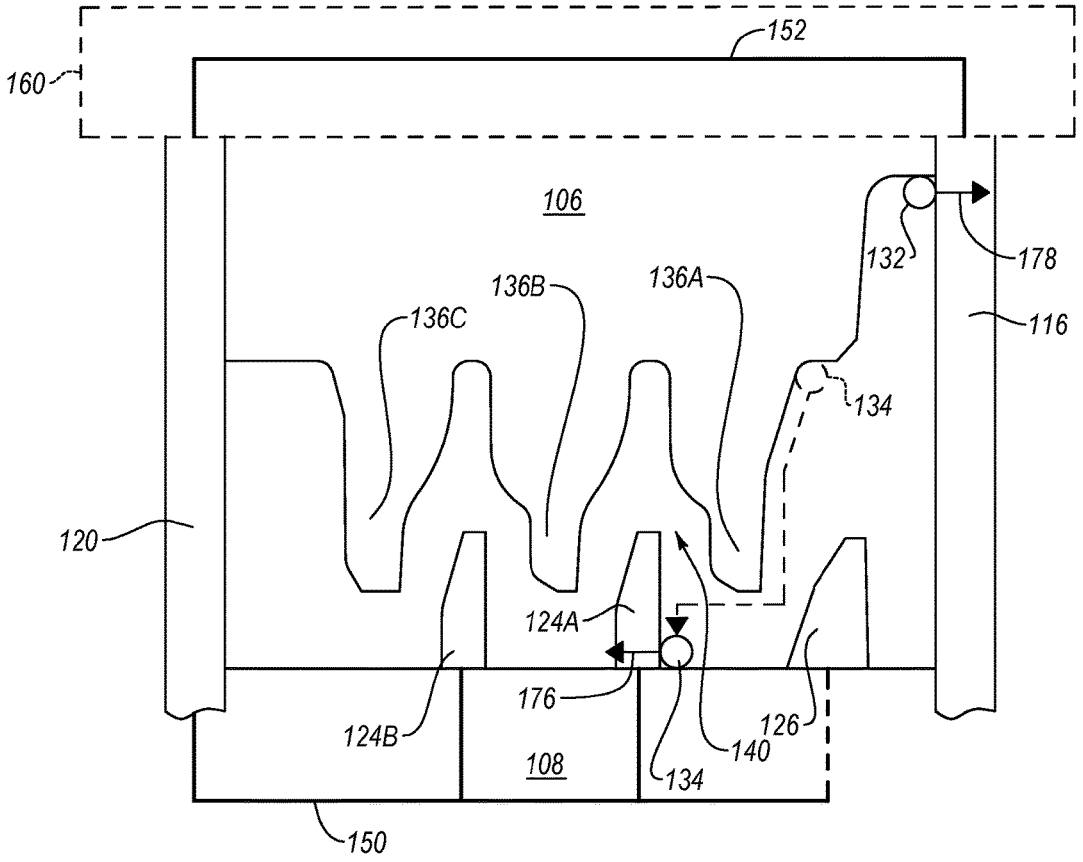
FIG. 8C illustrates a schematic representation of the use-limiting connector of FIG. 8A, in a third stage of the life cycle of the use-limiting connector, according to one or more examples of the present disclosure.

Now referring to FIG. 8C, according to a third stage of the use-limiting connector 100, as the use-limiting connector 100 is demated from the tool controller 172 for the first time, the plunger 110 moves in the second direction 168 from the second position to the first position. Movement of the plunger 110 in the second direction 168 results in movement of the seat 113 of the plunger 110 in the second direction 168, which allows decompression of the biasing member 130. Decompression of the biasing member 130 causes the second electrical contact 134 to move in the second direction 168 along with the plunger 110. As indicated by the path in dashed lines, the torsional bias of the biasing member 130 maintains the second electrical contact 134 against the non-electrical stop 136A as the second electrical contact 134 moves in the second direction 168 until the second electrical contact 134 clears the non-electrical stop 136A, at which time the torsional bias of the biasing member 130 causes the second electrical contact 134 to rotate in the first circumferential direction 176 until it engages the electrical stop 124A. The second electrical contact 134 travels along the electrical stop 124A substantially in the second direction 168 until the plunger 110 reaches the first position (associated with a complete demating of the use-limiting connector 100 with the tool controller 172), at which time the second electrical contact 134 remains engaged with the electrical stop 124A by virtue of the torsional bias in the first circumferential direction 176. As indicated schematically, the electrical contacts 124A-B are electrically coupled to the second electrical terminal 120 via an electrical trace 150. Because the electrical circuit is closed, control of the tool by the tool controller 172 is disabled. Accordingly, if a user cut off the plunger 110 at this time, the electrical circuit would remain closed and control of the tool would remain disabled should the user again mate the use-limiting connector 100 with the tool controller 172.

Figure 8D:
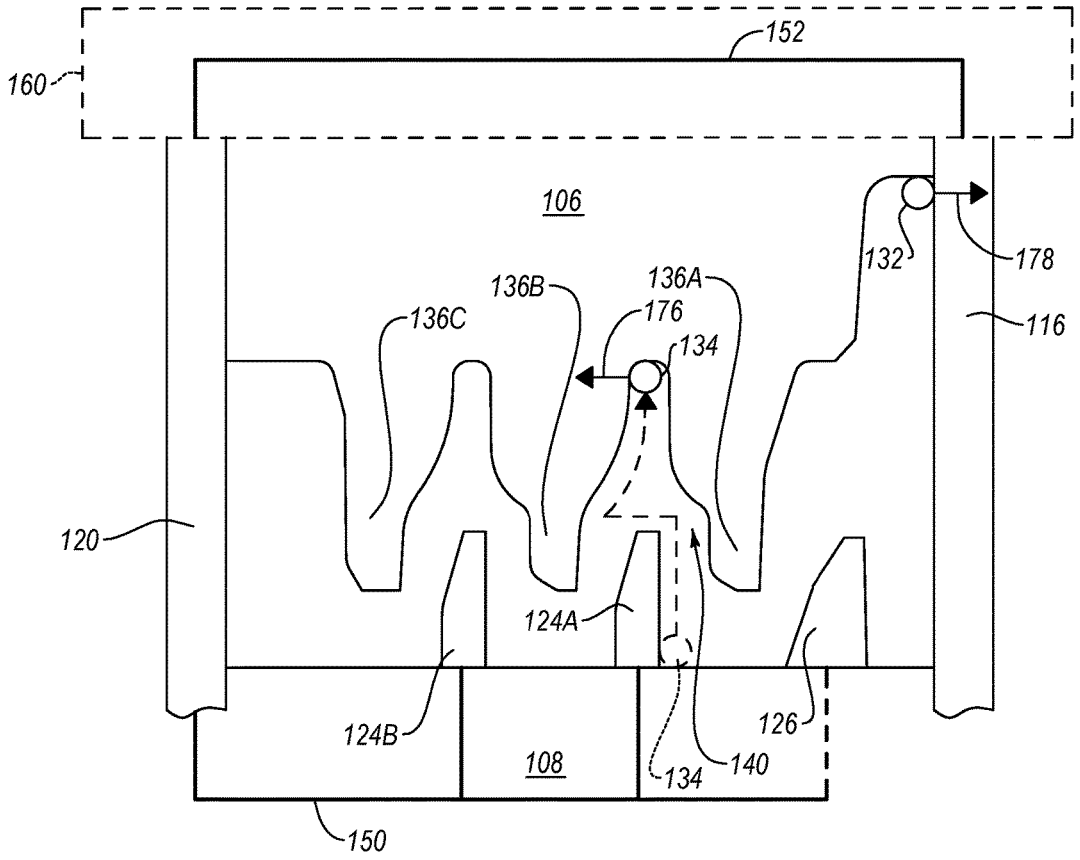
FIG. 8D illustrates a schematic representation of the use-limiting connector of FIG. 8A, in a fourth stage of the life cycle of the use-limiting connector, according to one or more examples of the present disclosure.

Referring to FIG. 8D, according to a fourth stage of the use-limiting connector 100, should the use-limiting connector 100 be mated to the tool controller 172 a second time, the plunger 110 moves in the first direction 166 from the first position to the second position as described above. Movement of the plunger 110 in the first direction 166 results in the seat 113 of the plunger 110 engaging and further compressing the biasing member 130. Compression of the biasing member 130 causes the second electrical contact 134 to move in the first direction 166 along with the plunger 110. As indicated by the path in dashed lines, the torsional bias of the biasing member 130 maintains the second electrical contact 134 against the electrical stop 124A as the second electrical contact 134 moves in the first direction 166 until the second electrical contact 134 clears the electrical stop 124A, at which time the torsional bias of the biasing member 130 causes the second electrical contact 134 to rotate in the first circumferential direction 176 until it engages the non-electrical stop 136B. The second electrical contact 134 travels along the non-electrical stop 136B substantially in the first direction 166 until the plunger 110 reaches the second position, at which time the second electrical contact 134 remains engaged with the non-electrical stop 136B by virtue of the torsional bias in the first circumferential direction 176. Because the electrical circuit is open, after the second mating of the use-limiting connector 100 with the tool controller 172, control of the tool by the tool controller 172 is enabled.

Figure 8E:
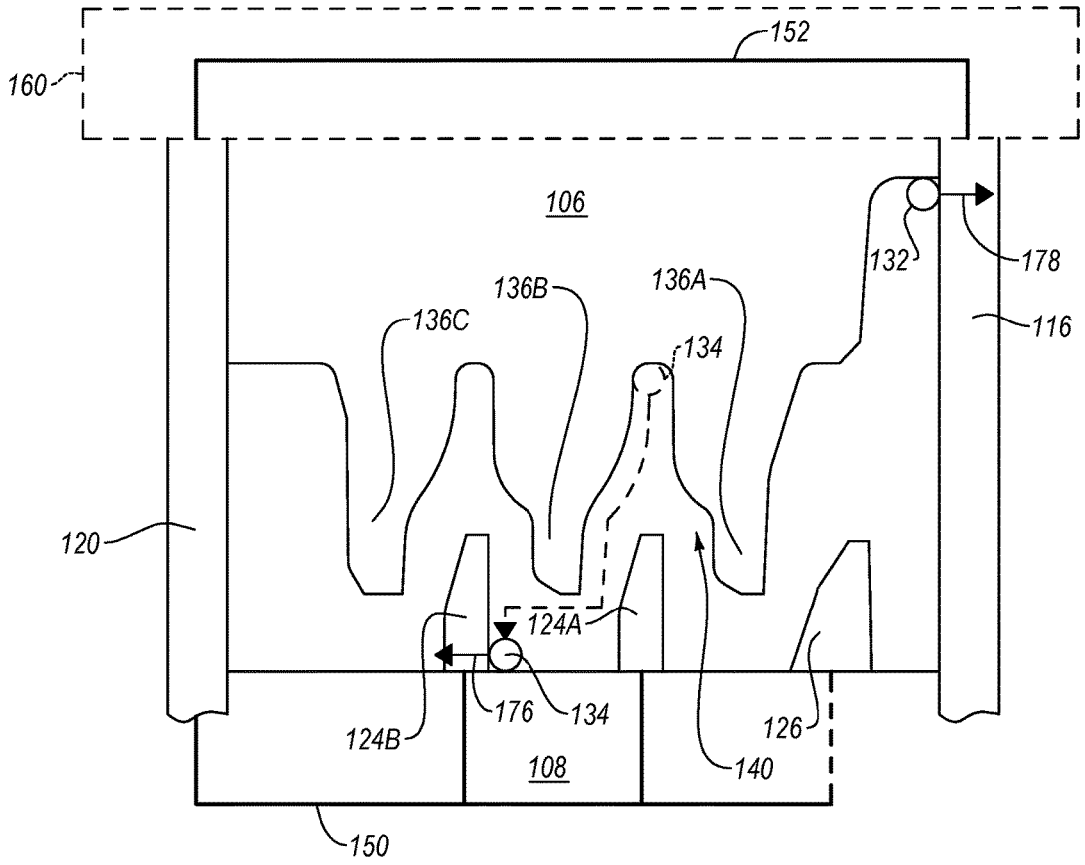
FIG. 8E illustrates a schematic representation of the use-limiting connector of FIG. 8A, in a fifth stage of the life cycle of the use-limiting connector, according to one or more examples of the present disclosure.

Now referring to FIG. 8E, according to a fifth stage of the use-limiting connector 100, as the use-limiting connector 100 is demated from the tool controller 172 for the second time, the plunger 110 moves in the second direction 168 from the second position to the first position. Movement of the plunger 110 in the second direction 168 results in movement of the seat 113 of the plunger 110 in the second direction 168, which allows decompression of the biasing member 130. Decompression of the biasing member 130 causes the second electrical contact 134 to move in the second direction 168 along with the plunger 110. As indicated by the path in dashed lines, the torsional bias of the biasing member 130 maintains the second electrical contact 134 against the non-electrical stop 136B as the second electrical contact 134 moves in the second direction 168 until the second electrical contact 134 clears the non-electrical stop 136B, at which time the torsional bias of the biasing member 130 causes the second electrical contact 134 to rotate in the first circumferential direction 176 until it engages the electrical stop 124B. The second electrical contact 134 travels along the electrical stop 124B substantially in the second direction 168 until the plunger 110 reaches the first position, at which time the second electrical contact 134 remains engaged with the electrical stop 124B by virtue of the torsional bias in the first circumferential direction 176. Again, because the electrical circuit is closed, control of the tool by the tool controller 172 is disabled. Accordingly, if a user cut off the plunger 110 at this subsequent time, the electrical circuit would remain closed and control of the tool would remain disabled should the user again mate the use-limiting connector 100 with the tool controller 172.

Figure 8F:
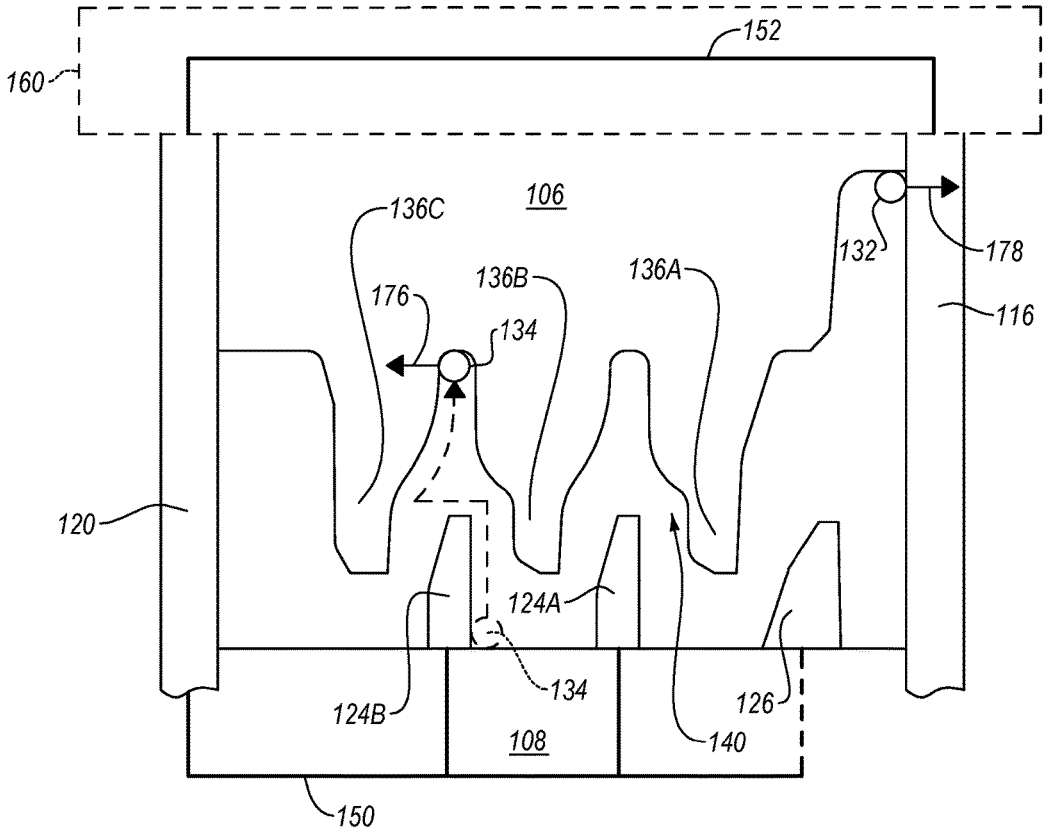
FIG. 8F illustrates a schematic representation of the use-limiting connector of FIG. 8A, in a sixth stage of the life cycle of the use-limiting connector, according to one or more examples of the present disclosure.

Referring to FIG. 8F, according to a sixth stage of the use-limiting connector 100, should the use-limiting connector 100 be mated to the tool controller 172 a third time, the plunger 110 moves in the first direction 166 from the first position to the second position as described above. Movement of the plunger 110 in the first direction 166 results in the seat 113 of the plunger 110 engaging and further compressing the biasing member 130. Compression of the biasing member 130 causes the second electrical contact 134 to move in the first direction 166 along with the plunger 110. As indicated by the path in dashed lines, the torsional bias of the biasing member 130 maintains the second electrical contact 134 against the electrical stop 124B as the second electrical contact 134 moves in the first direction 166 until the second electrical contact 134 clears the electrical stop 124B, at which time the torsional bias of the biasing member 130 causes the second electrical contact 134 to rotate in the first circumferential direction 176 until it engages the non-electrical stop 136C. The second electrical contact 134 travels along the non-electrical stop 136C substantially in the first direction 166 until the plunger 110 reaches the second position, at which time the second electrical contact 134 remains engaged with the non-electrical stop 136C by virtue of the torsional bias in the first circumferential direction 176. Because the electrical circuit is open, after the third mating of the use-limiting connector 100 with the tool controller 172, control of the tool by the tool controller 172 is enabled.

Figure 8G:
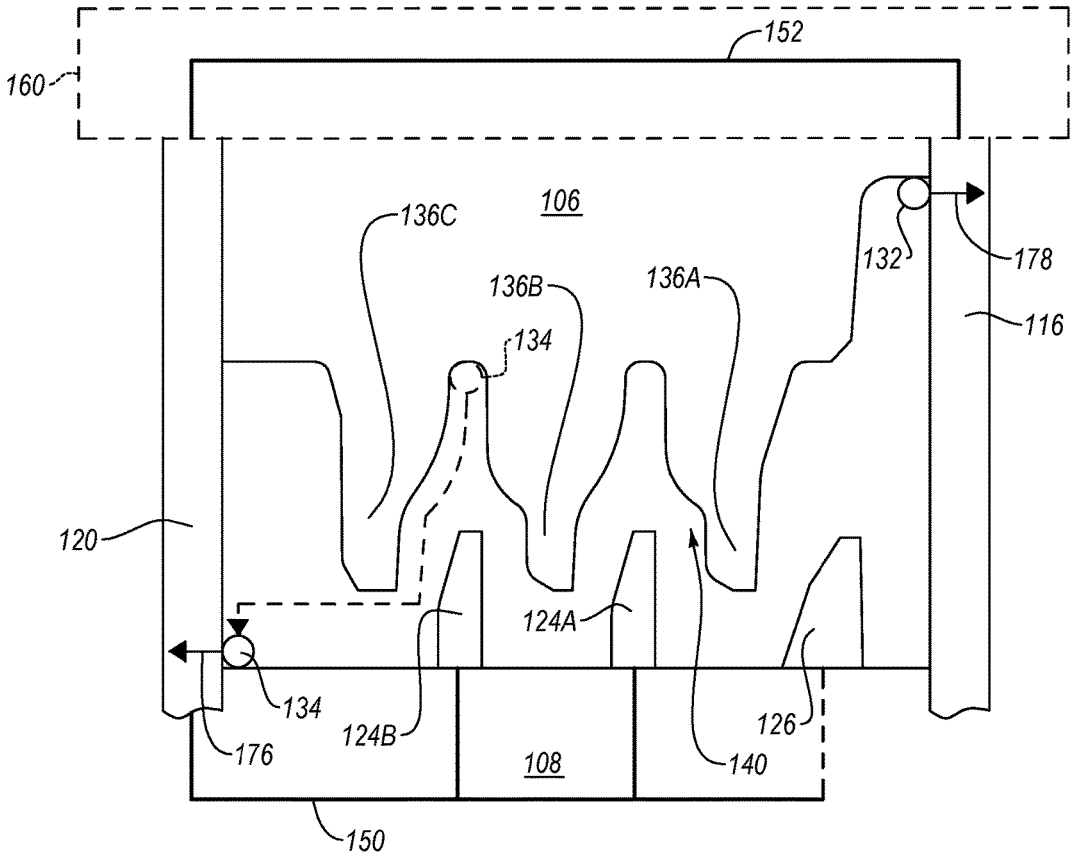
FIG. 8G illustrates a schematic representation of the use-limiting connector of FIG. 8A, in a seventh stage of the life cycle of the use-limiting connector, according to one or more examples of the present disclosure.

Now referring to FIG. 8G, according to a seventh stage of the use-limiting connector 100, as the use-limiting connector 100 is demated from the tool controller 172 for the third time, the plunger 110 moves in the second direction 168 from the second position to the first position. Movement of the plunger 110 in the second direction 168 results in movement of the seat 113 of the plunger 110 in the second direction 168, which allows decompression of the biasing member 130. Decompression of the biasing member 130 causes the second electrical contact 134 to move in the second direction 168 along with the plunger 110. As indicated by the path in dashed lines, the torsional bias of the biasing member 130 maintains the second electrical contact 134 against the non-electrical stop 136C as the second electrical contact 134 moves in the second direction 168 until the second electrical contact 134 clears the non-electrical stop 136C, at which time the torsional bias of the biasing member 130 causes the second electrical contact 134 to rotate in the first circumferential direction 176 until it engages the second electrical terminal 120. The second electrical contact 134 travels along the second electrical terminal 120 in the second direction 168 until the plunger 110 reaches the first position, at which time the second electrical contact 134 remains engaged with the second electrical terminal 120 by virtue of the torsional bias in the first circumferential direction 176. Again, because the electrical circuit is closed, control of the tool by the tool controller 172 is disabled. Accordingly, if a user cut off the plunger 110 at this time, the electrical circuit would remain closed and control of the tool would remain disabled should the user again mate the use-limiting connector 100 with the tool controller 172.

Figure 8H:
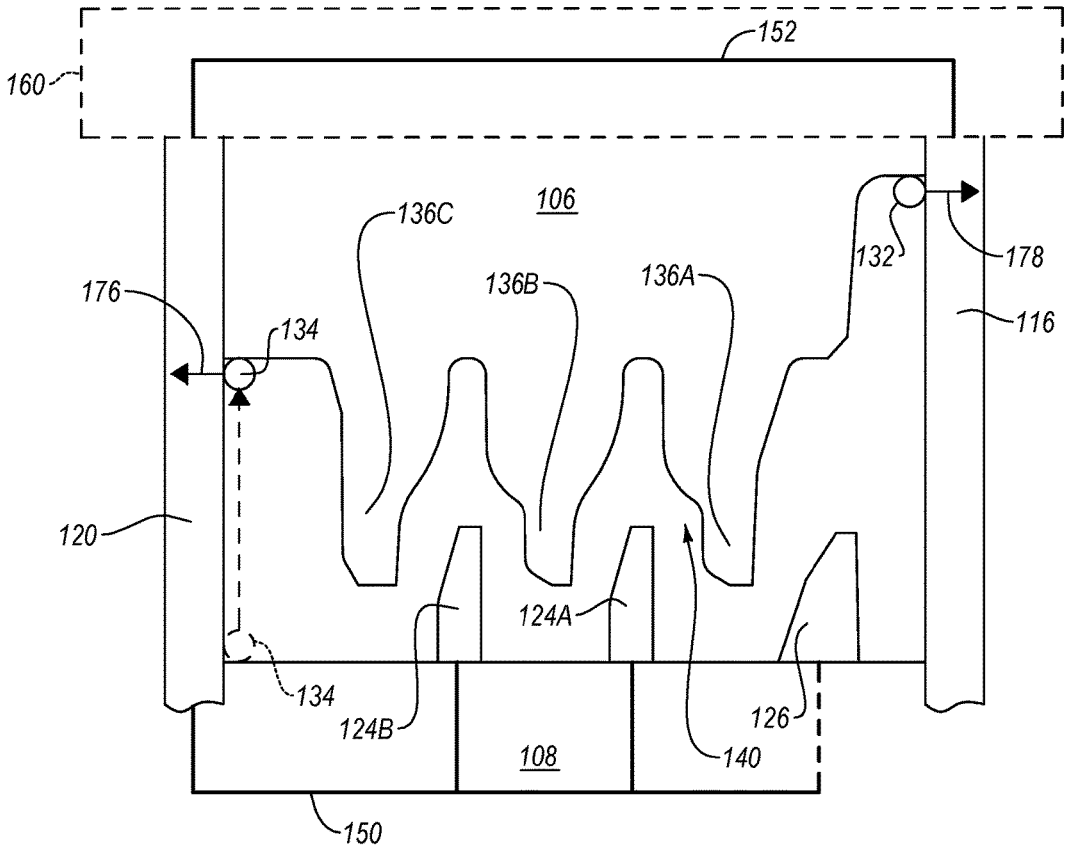
FIG. 8H illustrates a schematic representation of the use-limiting connector of FIG. 8A, in an eighth stage of the life cycle of the use-limiting connector, according to one or more examples of the present disclosure.

Once the use-limiting connector 100 is placed in the configuration of FIG. 8H, according to an eighth stage or final stage of the use-limiting connector 100, the use-limiting connector 100 has reached the end of its life cycle such that any further attempts to mate the use-limiting connector 100 will not enable the tool controller 172. For example, as shown in FIG. 8G, should the use-limiting connector 100 be mated to the tool controller 172 a fourth or subsequent time, the plunger 110 moves in the first direction 166 from the first position to the second position as described above. As indicated by the path in dashed lines, the torsional bias of the biasing member 130 maintains the second electrical contact 134 against the second electrical terminal 120 as the second electrical contact 134 moves in the first direction 166 all the way to the second position. Demating the use-limiting connector 100 from the tool controller 172 will only cause the second electrical contact 134 to move along, but remain in contact with, the second electrical terminal 120 in the second direction 168. In other words, the second electrical contact 134 is permanently in electrical contact with the second electrical terminal 120 after the last allowed enablement of the tool controller 172 control over the electrical tool 170. Because the electrical circuit remains closed, after the third demating of the use-limiting connector 100 with the tool controller 172, control of the tool by the tool controller 172 is permanently disabled.

Because the use-limiting connector 100 of the illustrated embodiments has three open circuit positions of the second electrical contact 134 before the second electrical contact 134 is placed in contact with the second electrical terminal 120, the predetermined use limit of the use-limiting connector 100 is three. However, in other embodiments, the predetermined use limit is less than three (e.g., two or one) or more than three. For example, in one embodiment, the use-limiting connector 100 may not have any electrical stops 124A-B and have only one of the non-electrical stops 136A-C such that after the initial mating and demating of the use-limiting connector 100, the torsional bias of the biasing member 130 urges the second electrical contact 134 into contact with the second electrical terminal 120.

Although the biasing member 130 is depicted as a spring in the illustrated embodiments, in other embodiments the biasing member 130 can be another type of biasing member, such as a magnetically-driven biasing member. For example, the biasing member 130 can any of various biasing members 130 that adjustably urge opposing electrical contacts, of an electrically conductive element, away from each other in the first and second directions 166, 168, respectively, and the first and second circumferential directions 176, 178, respectively.

Figure 9:
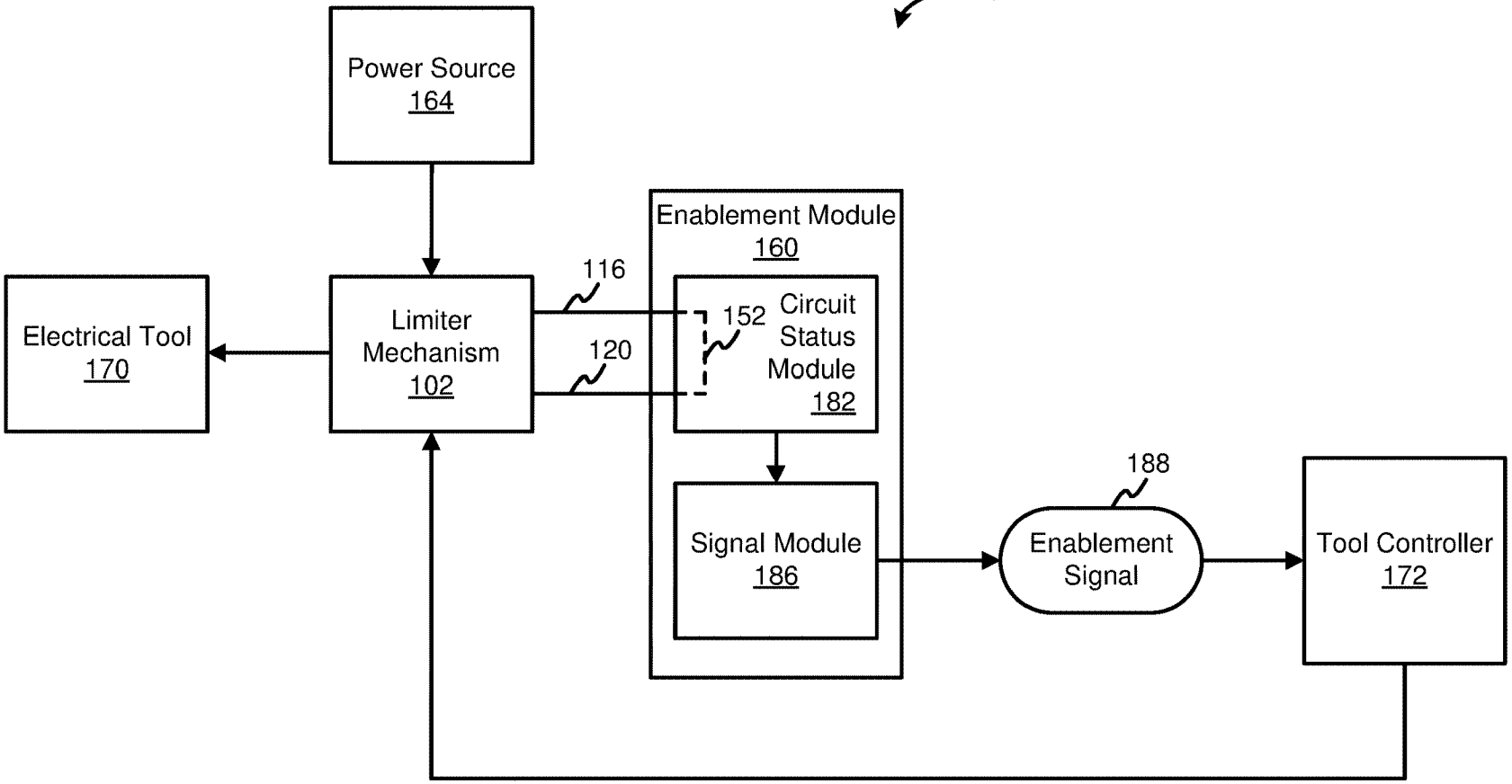
FIG. 9 illustrates a schematic block diagram of a system for limiting use of an electrical tool, according to one or more examples of the present disclosure.

Referring to FIG. 9, according to one embodiment of a system 202, the enablement module 160 is configured to generate an enablement signal 188 based on the condition of the electrical circuit, at least partially formed by the use-limiting connector 100. In response to the enablement signal 188, the ability of the tool controller 172 to control operation of the electrical tool 170 is either enabled or disabled. Accordingly, the enablement signal 188 may command either enablement or disablement of the tool controller 172. The circuit status module 182 of the enablement module 160 determines the condition (e.g., open or closed) of the electrical circuit by monitoring the electrical state of the electrical trace 152. In response to the electrical state of the electrical trace 152 determined by the circuit status module 182, the signal module 186 of the enablement module 160 generates the enablement signal 188, which is communicated to the tool controller 172.

In one embodiment, if electrical current is flowing through the electrical trace 152 between the first and second electrical terminals 116, 120, then the circuit status module 182 determines that the electrical circuit is closed and the signal module 186 generates a signal commanding enablement of the tool controller 172. However, if electrical current is not flowing through the electrical trace 152 between the first and second electrical terminals 116, 120, then the circuit status module 182 determines that the electrical circuit is open and the signal module 186 generates a signal commanding disablement of the tool controller 172. The circuit status module 182 may include any of various electrical-current monitoring devices for detecting electrical current in the electrical trace 152. Again, as mentioned above, the enablement module 160 can be part the use-limiting connector 100, the tool controller 172, and/or another electronic device.

In another embodiment, the circuit status module 182 is configured to determine a characteristic (e.g., amplitude, frequency, pattern, etc.) of the current passing through the electrical trace 152. For example, if the amplitude is at a first threshold, then the signal module 186 generates a signal commanding disablement of the tool controller 172. However, if the amplitude is at a second threshold, different than the first threshold, then the signal module 186 generates a signal commanding enablement of the tool controller 172. In such an embodiment, current is always passing through the first and second electrical terminals 116, 120, but depending on the position of the second electrical contact 134 of the biasing member 130, the current is routed through one of two electrical paths to the electrical trace 152. Each electrical path produces a different amplitude of the electrical current passing through the electrical trace 152. The different amplitude can be produced using any of various electrical components, such as resistors, capacitors, etc.

Electrical power is provided to the electrical circuit by a power source 164. The power source 164 forms part of the tool controller 172 in some embodiments. In other embodiments, the power source 164 forms part of the use-limiting connector 100, such as a battery onboard the base 104.

Figure 10:
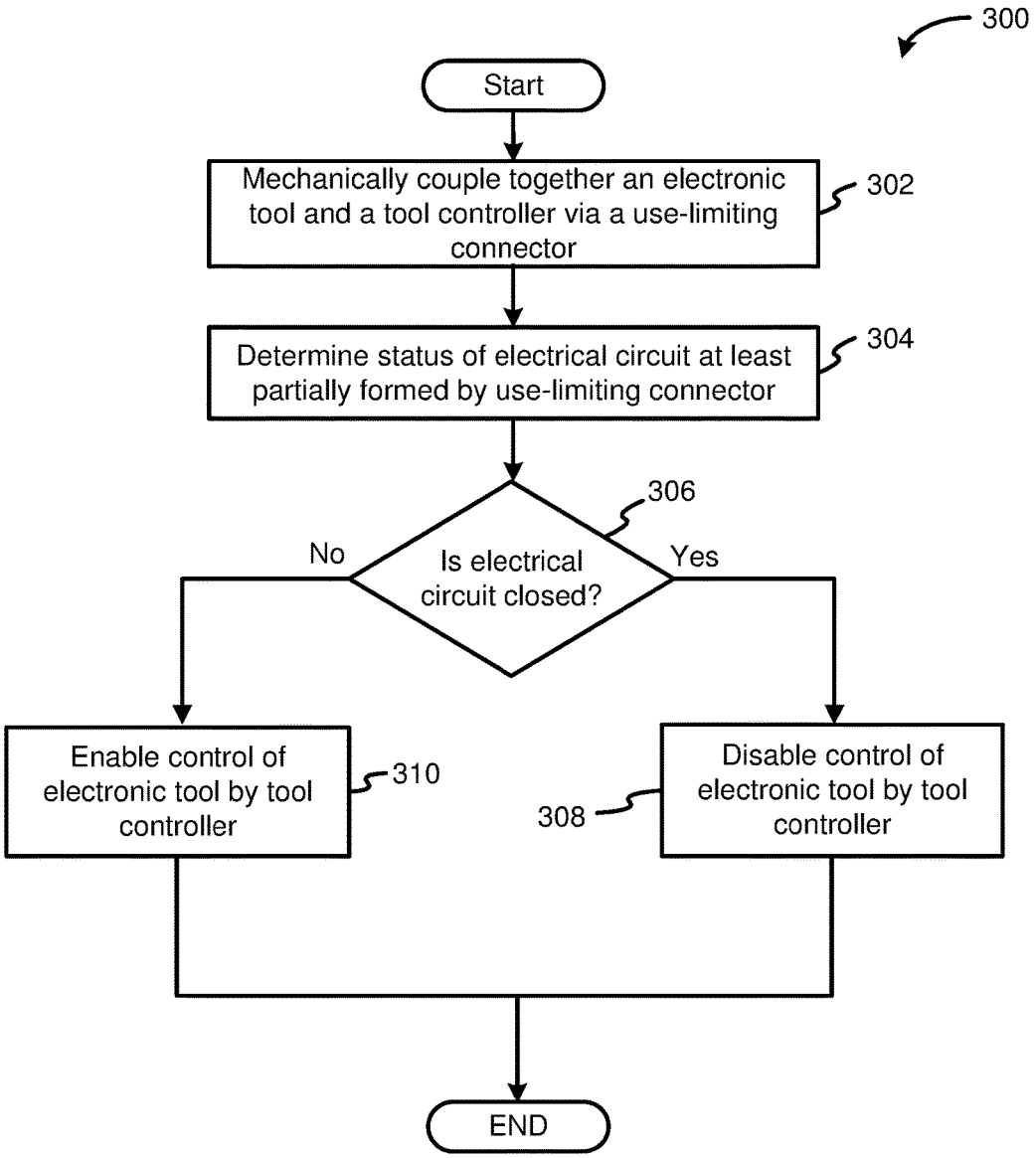
FIG. 10 illustrates a schematic flow chart of a method of limiting use of an electrical tool, according to one or more examples of the present disclosure.

Referring to FIG. 10, according to one embodiment, a method 300 of limiting use of an electrical tool 170 includes mechanically coupling together a tool and a tool controller via a use-limiting connector at 302. The method 300 also includes determining a status of an electrical circuit at least partially formed by the use-limiting connector at 304. The method 300 further includes determining whether the electrical circuit is open or closed at 306. If the electrical circuit is closed, then the method 300 includes disabling control of the tool by the tool controller at 308. However, if the electrical circuit is open, then the method 300 enables control of the tool by the tool controller at 310.

Figure 11:
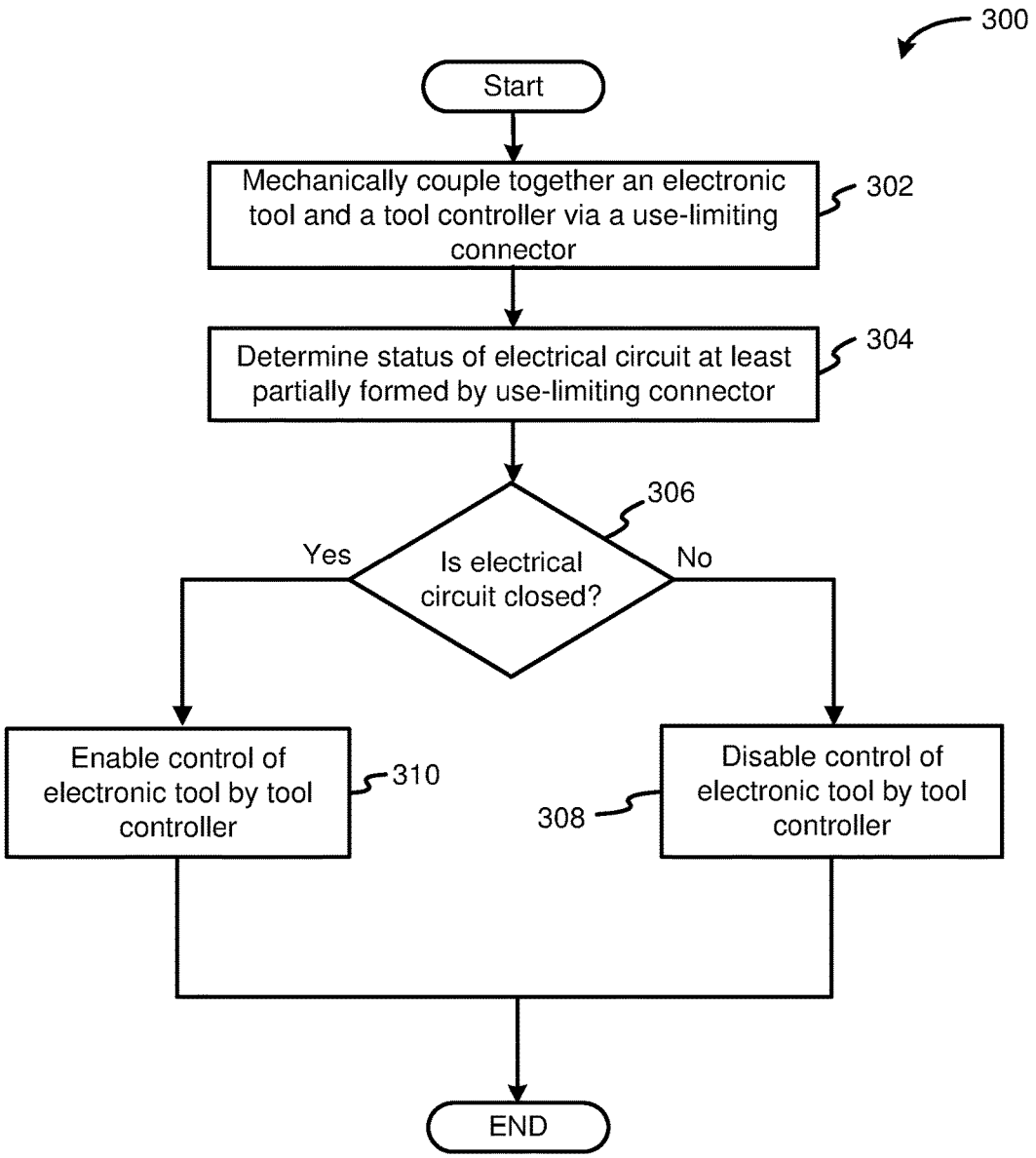
FIG. 11 illustrates a schematic flow chart of a method of limiting use of an electrical tool, according to one or more examples of the present disclosure.

In alternative embodiments, such as shown in FIG. 11, the method 300 is effectively inverted such that when the electrical circuit is closed, control of the electrical tool by the tool controller is enabled and when the electrical circuit is open, control of the electrical tool by the tool controller is disabled. For example, referring to FIG. 11, if the electrical circuit is closed at 306, then the method 300 includes enabling control of the tool by the tool controller at 310. However, if the electrical circuit is open at 306, then the method 300 disables control of the tool by the tool controller at 308. Such an embodiment can be established by switching certain electrically conductive elements of the use-limiting connector 100 (e.g., second electrical terminal 120, electrical stops 124A-B) to be made of an electrically non-conductive material instead of an electrically conductive material, and switching certain electrically non-conductive elements of the use-limiting connector 100 (e.g., non-electrical stop 126 and non-electrical stops 136A-C) to be made of an electrically conductive material instead of an electrically non-conductive material. Such an embodiment would also include means for electrically coupling the now electrical stops 136A-C and now electrical stop 126 with the first electrical terminal 116 via the biasing member 130 when the second electrical contact 134 of the biasing member 130 is in contact with any one of the now electrical stops 136A-C and now electrical stop 126.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The described features, structures, or characteristics of the embodiments may be combined in any suitable manner. In the above description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. These code may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A use-limiting connector for limiting use of an electrical tool, the use-limiting connector comprising:

an electrical circuit;

a plunger, movable between a first position and a second position; and a biasing member, configured to urge the plunger into the first position and configured to incrementally uncoil into respective torsional states as the plunger moves between the first position and the second position;

wherein:

with the plunger in the first position and the biasing member in a first one of the torsional states, the biasing member closes the electrical circuit; and as the plunger moves from the first position to the second position, the plunger moves the biasing member to open the electrical circuit.

2. The use-limiting connector according to claim 1, wherein after the plunger moves a predetermined number of times from the first position to the second position, the biasing member permanently closes the electrical circuit.

3. The use-limiting connector according to claim 2, wherein the predetermined number of times is one.

4. The use-limiting connector according to claim 2, wherein the predetermined number of times is more than one.

5. The use-limiting connector according to claim 1, further comprising:

a first electrical terminal;

a second electrical terminal; and a first non-electrical stop between the first electrical terminal and the second electrical terminal, wherein the first non-electrical stop is electrically isolated from the first electrical terminal and the second electrical terminal;

wherein the biasing member slides along the first non-electrical stop as the plunger moves between the first position and the second position.

6. The use-limiting connector according to claim 5, further comprising a first electrical stop between the first non-electrical stop and the second electrical terminal, wherein:

the first electrical stop is electrically coupled to the second electrical terminal; and the biasing member alternately slides along the first non-electrical stop and the first electrical stop as the plunger moves between the first position and the second position.

7. The use-limiting connector according to claim 6, further comprising a second non-electrical stop between the first electrical stop and the second electrical terminal, wherein:

the second non-electrical stop is electrically isolated from the first electrical terminal and the second electrical terminal; and the biasing member alternately slides along the first electrical stop and the second non-electrical stop as the plunger moves between the first position and the second position.

8. The use-limiting connector according to claim 7, wherein:

a path is defined between the first non-electrical stop and the first electrical stop and between the second non-electrical stop and the first electrical stop; and the path bends around the first electrical stop.

9. The use-limiting connector according to claim 6, wherein:

the biasing member is made of an electrically conductive material and comprises a first electrical contact and a second electrical contact;

the first electrical contact is biased against the first electrical terminal;

the second electrical contact is biased away from the first electrical terminal toward the second electrical terminal;

when the plunger is in the second position, the second electrical contact of the biasing member is biased against the first non-electrical stop to electrically decouple the first electrical terminal and the second electrical terminal via the biasing member; and movement of the plunger from the second position to the first position urges the second electrical contact away from the first non-electrical stop and into contact with the first electrical stop to electrically couple together the first electrical terminal and the second electrical terminal.

10. The use-limiting connector according to claim 6, further comprising:

a housing, at least partially enclosing the plunger and the biasing member, wherein the housing is made from an electrically non-conductive material and partially electrically insulates the first electrical stop; and an electrical bridge, made from an electrically conductive material and permanently electrically coupling together the first electrical stop and the second electrical terminal.

11. The use-limiting connector according to claim 5, wherein the biasing member is made of an electrically conductive material and comprises a first electrical contact and a second electrical contact;

the first electrical contact is biased against the first electrical terminal;

the second electrical contact is biased away from the first electrical terminal toward the second electrical terminal;

when the plunger is in the second position, the second electrical contact of the biasing member is biased against the first non-electrical stop to electrically decouple the first electrical terminal and the second electrical terminal via the biasing member; and movement of the plunger from the second position to the first position urges the second electrical contact away from the first non-electrical stop and into permanent contact with the second electrical terminal to permanently electrically couple together the first electrical terminal and the second electrical terminal via the biasing member.

12. The use-limiting connector according to claim 5, further comprising a second electrical stop immediately between the first non-electrical stop and the first terminal, wherein:

the second electrical stop is electrically coupled to the second electrical terminal; and the biasing member alternately slides along the second electrical stop and the first non-electrical stop as the plunger moves between the first position and the second position.

13. The use-limiting connector according to claim 5, further comprising a second non-electrical stop immediately between the first non-electrical stop and the first terminal, wherein:

the second non-electrical stop is electrically isolated from the first electrical terminal and the second electrical terminal; and the biasing member alternately slides along the first non-electrical stop and the second non-electrical stop as the plunger moves between the first position and the second position.

14. The use-limiting connector according to claim 13, wherein:

the biasing member is made of an electrically conductive material and comprises a first electrical contact and a second electrical contact;

the first electrical contact is biased against the first electrical terminal;

the second electrical contact is biased away from the first electrical terminal toward the second electrical terminal;

with the plunger in the first position and the biasing member in a second one of the torsional states, the second electrical contact of the biasing member is biased against the second non-electrical stop to electrically decouple the first electrical terminal and the second electrical terminal; and movement of the plunger from the first position to the second position urges the second electrical contact away from the second non-electrical stop and into contact with the first non-electrical stop to retain electrical decoupling of the first electrical terminal and the second electrical terminal.

15. A system for limiting use of an electrical tool, the system comprising:

a use-limiting connector coupled to the electrical tool, wherein the use-limiting connector comprises:

an electrical circuit;

a plunger, movable between a first position and a second position; and a biasing member, configured to urge the plunger into the first position;

wherein:

with the plunger in the first position, the biasing member closes the electrical circuit;

as the plunger moves from the first position to the second position, the plunger moves the biasing member to open the electrical circuit; and after the plunger moves a predetermined number of times from the first position to the second position, the biasing member permanently closes the electrical circuit; and a tool controller comprising a port configured to be mechanically and electrically coupled to the use-limiting connector, wherein:

the port is further configured to urge the plunger into the second position when the use-limiting connector is mechanically coupled to the port; and control of the electrical tool by the tool controller through the use-limiting connector is enabled when the electrical circuit is open and disabled when the electrical circuit is closed.

16. A method of limiting use of an electrical tool, the method comprising:

mechanically coupling together an electrical tool and a tool controller via a use-limiting connector, wherein the use-limiting connector comprises an electrical circuit;

determining whether the electrical circuit of the use-limiting connector is open or closed;

when the electrical circuit is closed, disabling control of the electrical tool by the tool controller; and when the electrical circuit is open, enabling control of the electrical tool by the tool controller.

17. The method according to claim 16, wherein the electrical circuit is permanently closed after the use-limiting connector is used a predetermined number of times to mechanically couple together the electrical tool and the tool controller.

18. The method according to claim 17, wherein:

the electrical circuit is closed when a biasing member of the use-limiting connector is electrically coupled to a second electrical terminal of the use-limiting connector;

the electrical circuit is open when the biasing member of the use-limiting connector is electrically decoupled from the second electrical terminal of the use-limiting connector;

mechanically coupling together the electrical tool and the tool controller moves a plunger of the use-limiting connector from a first position to a second position; and the method further comprises electrically coupling the biasing member and the second electrical terminal when:

the plunger is in the first position and before the use-limiting connector is used the predetermined number of times; and the plunger is in the second position and after the use-limiting connector is used the predetermined number of times; and the method further comprises electrically decoupling the biasing member and the second electrical terminal when the plunger is in the second position and before the use-limiting connector is used the predetermined number of times.

19. A method of limiting use of an electrical tool, the method comprising:

mechanically coupling together an electrical tool and a tool controller via a use-limiting connector, wherein the use-limiting connector comprises an electrical circuit;

determining whether the electrical circuit of the use-limiting connector is open or closed;

when the electrical circuit is closed, enabling control of the electrical tool by the tool controller; and when the electrical circuit is open, disabling control of the electrical tool by the tool controller.

20. The method according to claim 19, wherein:

the electrical circuit is permanently open after the use-limiting connector is used a predetermined number of times to mechanically couple together the electrical tool and the tool controller;

the electrical circuit is open when a biasing member of the use-limiting connector is non-electrically coupled to a non-electrical terminal or a non-electrical stop of the use-limiting connector;

the electrical circuit is closed when the biasing member of the use-limiting connector is electrically coupled to an electrical stop of the use-limiting connector;

mechanically coupling together the electrical tool and the tool controller moves a plunger of the use-limiting connector from a first position to a second position; and the method further comprises non-electrically coupling the biasing member and the non-electrical terminal or the non-electrical stop when:

the plunger is in the first position and before the use-limiting connector is used the predetermined number of times; and the plunger is in the second position and after the use-limiting connector is used the predetermined number of times; and the method further comprises electrically coupling the biasing member and the electrical stop when the plunger is in the second position and before the use-limiting connector is used the predetermined number of times.

* * * * *